US005481976A

United States Patent [19]

Hashimura et al.

[11] Patent Number: 5,481,976

[45] Date of Patent: Jan. 9, 1996

[54] PRINTING ROLL AND ELASTIC PLATE INSTALLED ON PRINTING ROLL

[75] Inventors: Yasuhiro Hashimura; Satoshi Noguchi; Kenichi Masaki; Takahiro Akai, all of Kyoto, Japan

[73] Assignee: Nissha Printing Co., Ltd., Kyoto, Japan

[21] Appl. No.: 387,716

[22] PCT Filed: Jun. 14, 1994

[86] PCT No.: PCT/JP94/00957

§ 371 Date: Feb. 15, 1995

§ 102(e) Date: Feb. 15, 1995

[87] PCT Pub. No.: WO94/29109

PCT Pub. Date: Dec. 22, 1994

[30] Foreign Application Priority Data

Jun. 16, 1993 [JP] Japan ..... 5-171161
Jun. 16, 1993 [JP] Japan ..... 5-171162

[51] Int. Cl.[6] ..... B41F 1/28

[52] U.S. Cl. ..... 101/415.1; 101/477

[58] Field of Search ..... 101/415.1, 378, 101/382, 477

[56] References Cited

U.S. PATENT DOCUMENTS

| | | | |
|---|---|---|---|
| 1,350,488 | 8/1920 | Blaine | 101/415.1 |
| 3,151,554 | 10/1964 | Townsend | 101/415.1 |
| 3,154,012 | 10/1964 | Fischer | 101/415.1 |
| 4,259,904 | 4/1981 | Metje | 101/415.1 |
| 5,052,120 | 10/1991 | Lubberts | 101/415.1 |
| 5,229,312 | 11/1993 | Simeth et al. | 101/415.1 |
| 5,408,297 | 4/1995 | Matsuo et al. | 101/415.1 |

FOREIGN PATENT DOCUMENTS

| | | |
|---|---|---|
| 55-52433 | 12/1980 | Japan . |
| 62-174157 | 7/1987 | Japan . |
| 62-53347 | 11/1987 | Japan . |
| 63-191636 | 8/1988 | Japan . |

*Primary Examiner*—Eugene H. Eickholt
*Attorney, Agent, or Firm*—Wenderoth, Lind & Ponack

[57] ABSTRACT

A thin-film forming elastic plate of a printing roll includes a first elastic plate holder having a first printing roll-chucking hole formed therein, and a second elastic plate holder in which a second printing roll-chucking hole having a tapered portion is formed. A printing roll barrel includes a first chuck including a first chucking member having a claw and a first driving portion for moving the claw of the first chucking member into engagement with an edge of the first elastic plate holder defining the opening of the first printing roll-chucking hole; and second chuck including a tapered portion corresponding to the tapered portion of the second printing roll-chucking hole of the second elastic plate holder, and a second driving portion for moving the second chucking member.

20 Claims, 18 Drawing Sheets

PRINTING ROLL AND ELASTIC PLATE INSTALLED ON PRINTING ROLL

BACKGROUND OF THE INVENTION

1. Field of the Invention

The present invention relates to a printing roll and a thin-film forming elastic plate which can be easily fixed to a printing roll barrel by pressing an elastic plate holder mounted on the thin-film forming elastic plate against the printing roll barrel and which can be easily pulled over the printing roll barrel without wrinkling the thin-film forming elastic plate in fixing the thin-film forming elastic plate to the printing roll barrel.

More specifically, as an apparatus for forming a macromolecular thin-film pattern used for electronic parts such as liquid crystal orientation films, a thin-film forming apparatus shown in FIG. 29 comprising the following components is known: an intaglio roll (A) having a plurality of ink cells; an ink supply means (B) having a doctor blade B2 for filling ink into the ink cells; a printing roll (C) having a thin-film forming elastic plate (E), installed on a barrel, to which the ink of an intaglio roll (A) is transferred; a printing table (D) for fixing thereto a to-be-printed material D2, to which the ink of the printing roll (C) is transferred. The present invention relates to a printing roll preferably used in such a thin-film forming apparatus and a thin-film forming elastic plate to be installed on the printing roll.

2. Description of the Related Art

A device, for fixing the thin-film forming elastic plate to the printing roll, to be used in such a thin-film forming apparatus is proposed by the present applicant and disclosed in Japanese Patent Application No. 3-348683. In the device, the thin-film forming elastic plate is installed on and removed from the surface of the printing roll barrel comprising a hooking portion having rotary type fixing screws and a pulling portion having rotary type pulling screws, with elastic plate holders having the printing roll-chucking holes for receiving the rotary type screws installed on both ends of an elastic portion of the thin-film forming elastic plate.

That is, the thin-film forming elastic plate is installed on the printing roll barrel as follows: The fixing screws of the hooking portion of the printing roll barrel are manually inserted into the printing roll-chucking holes of one of the elastic plate holders installed on the elastic portion; the fixing screws are manually tightened to fix the elastic plate holder to the printing roll barrel; the pulling screws of the pulling portion of the printing roll are manually inserted into the printing roll-chucking holes of the other elastic plate holder; and the pulling portion is moved by turning the pulling screws manually to apply tensile force to the elastic portion. In this manner, the thin-film forming elastic plate is installed on the printing roll barrel. In removing the thin-film forming elastic plate from the printing roll barrel, the pulling portion is moved by turning the pulling screws of the pulling portion manually to relieve the tensile force applied to the elastic portion; the fixing screws are loosened manually to release the thin-film forming elastic plate from the printing roll barrel; and the elastic plate holders are manually removed from the hooking portion of the printing roll barrel and the pulling portion thereof. In this manner, the thin-film forming elastic plate is removed from the printing roll barrel.

The above-described thin-film forming apparatus has the following problems:

(1) As described above, a chucking device comprising the hooking and pulling portions provided on the conventional printing roll barrel has only the fixing and pulling screws. Therefore, in order to fix the thin-film forming elastic plate to the printing roll barrel and release it therefrom, it is necessary to tighten and loosen the fixing screws manually and turn the pulling screws clockwise and counterclockwise manually. Thus, the operation of fixing the thin-film forming elastic plate to the printing roll barrel and removing it therefrom takes time and labor and is performed inefficiently.

(2) In fixing the thin-film forming elastic plate to the printing roll barrel by the conventional chucking device, initially, the operation of pressing the elastic plate holder of the thin-film forming elastic plate against the printing roll barrel is performed by tightening the fixing screws manually; and after this operation is completed, the operation of preventing the elastic plate from being wrinkled by pulling the elastic plate over the printing roll barrel is performed by rotating the pulling screws manually. Unless these two operations are carried out in this order, a disadvantage occurs in that the elastic plate is pulled with the elastic plate holder floating over the printing roll barrel or the rotary type screws cannot be inserted into the printing roll-chucking holes of the elastic plate holders.

Accordingly, in fixing the thin-film forming elastic plate to the printing roll barrel, it is necessary to perform screw-turning operations twice in consideration of the screw-turning order. Hence, it takes time and labor to fix the thin-film forming elastic plate to the printing roll barrel and the fixing operation is performed inefficiently.

In addition, in releasing the thin-film forming elastic plate from the printing roll barrel, initially, the operation of loosening the tensile force applied to the elastic portion is performed by manually rotating the pulling screws; and after this operation is performed, the operation of releasing the plate holder from the printing roll barrel is performed by loosening the fixing screws manually. Unless these two operations are carried out in this order, a disadvantage occurs in that the rotary type screws are not pulled out from the printing roll-chucking holes of the elastic plate holders.

Accordingly, in releasing the thin-film forming elastic plate from being fixed to the printing roll barrel, it is also necessary to perform screw-turning operations twice in consideration of the screw-turning order.

As described above, in the conventional art, the operation of fixing the thin-film forming elastic plate to the printing roll barrel and releasing it therefrom takes much time and labor and is performed inefficiently.

(3) In the conventional chucking device, a manual operation is required to fix the thin-film forming elastic plate to the printing roll barrel and release it therefrom. Thus, dust which has risen from an operator himself, operator's clothes, and the floor of a work place attaches to the thin-film forming elastic plate. In addition, dust and oil which have attached to the operator's hands attach to the thin-film forming elastic plate. Accordingly, the thickness of ink which has been transferred to the thin-film forming elastic plate becomes nonuniform or the ink is polluted.

(4) In the conventional chucking device, the hand may be sandwiched between the chucking device and the printing roll barrel and thus injured because it is necessary to pull the thin-film forming elastic plate and press the thin-film forming elastic plate against the printing roll barrel manually.

SUMMARY OF THE INVENTION

The present invention has been developed to solve the above-described problems, and it is an object of the present invention to provide a thin-film forming elastic plate which can be fixed to a printing roll barrel and removed therefrom without taking much time and labor and provide a printing roll which does not soil the thin-film forming elastic plate or injure an operator.

In accomplishing the above object, the present invention is constructed as follows:

That is, in one aspect of a printing roll according to the present invention, there is provided a printing roll wherein a thin-film forming elastic plate has an elastic portion (1) to which printing ink is applied; a first elastic plate holder (2), for holding the elastic portion at a leading end thereof wound firstly around a printing roll, having a first printing roll-chucking hole (80) penetrating through the first elastic plate holder in a thickness direction of the elastic portion; a second elastic plate holder (3), for holding the elastic portion at a trailing end thereof wound lastly around the printing roll, having a second printing roll-chucking hole (81) penetrating through the second elastic plate holder in the thickness direction of the elastic portion, and is wound around a printing roll barrel (503) in the order of the first elastic plate holder, the elastic portion, and the second elastic plate holder along a circumferential direction of the printing roll barrel thereof, the printing roll characterized by comprising:

a first chucking means (12), having a first placing base (19) provided on a part of the circumferential surface of the printing roll barrel, for placing the first elastic plate holder on a front surface side of the first placing base when winding the thin-film forming elastic plate on the printing roll; a first chucking member (25) penetrating through a through-hole formed on the first placing base from a rear surface side thereof to the front surface side thereof and penetrating into the first printing roll-chucking hole of the first elastic plate holder; and a first driving portion (26), provided on a rear side of the first placing base, for engaging the first chucking member penetrated into the first printing roll-chucking hole with the first printing roll-chucking hole, thus installing the first elastic plate holder on the first placing base, and a second chucking means (13), having a second placing base (190) provided on a part of the circumferential surface of the printing roll barrel, for placing the second elastic plate holder on a front surface side of the second placing base when winding the thin-film forming elastic plate on the printing roll; a second chucking member (15) penetrating through a through-hole formed on the second placing base from a rear surface side thereof to the front surface side thereof and penetrating into second printing roll-chucking hole of the second elastic plate holder; and a second driving portion (16), provided on the rear side of the second placing base, for engaging the second chucking member penetrated into the second printing roll-chucking hole with the second printing roll-chucking hole, thus installing the second elastic plate holder on the second placing base.

According to the above construction, merely hooking the first elastic plate holder and the second elastic plate holder of the thin-film forming elastic plate on the first chucking member of the printing roll barrel and the second chucking member thereof, respectively, allows the thin-film forming elastic plate carrying the first and second elastic plate holders to be automatically fixed to the printing roll barrel and released therefrom by the first and second driving portions.

In another aspect of the thin-film forming elastic plate of the present invention, there is provided a thin-film forming elastic plate, to be installed on a printing roll, comprising:

an elastic portion (1) to which printing ink is applied;

a first elastic plate holder (2), for holding the elastic portion at a leading end thereof wound firstly around a printing roll, having a hand-chucking hole (7) which is held and released by a hand (6) installed on an arm of a robot and penetrates through the first elastic plate holder in a thickness direction of the elastic portion; and a first printing roll-chucking hole (80) which is held and released by a first chucking means (12) of a printing roll barrel (503) and penetrates through the first elastic plate holder in the thickness direction of the elastic portion; and a second elastic plate holder (3), for holding the elastic portion at a trailing end thereof wound lastly around the printing roll, having a hand-chucking hole (7) which is held and released by the hand installed on the arm of the robot and penetrates through the second elastic plate holder in the thickness direction of the elastic portion; and a second printing roll-chucking hole (81) which is held and released by a second chucking means (13) of the printing roll barrel (503) and penetrates through the second elastic plate holder in the thickness direction of the elastic portion.

According to the above construction, the formation of the hand-chucking holes body and the printing roll-chucking holes on the first and second elastic plate holders allows the thin-film forming elastic plate to be held by the hand and the printing roll barrel and released therefrom.

BRIEF DESCRIPTION OF DRAWINGS

These and other objects and features of the present invention will become clear from the following description of the preferred embodiments thereof made with reference to the accompanying drawings, in which.

BEST MODE FOR CARRYING OUT THE INVENTION

Figure 1:
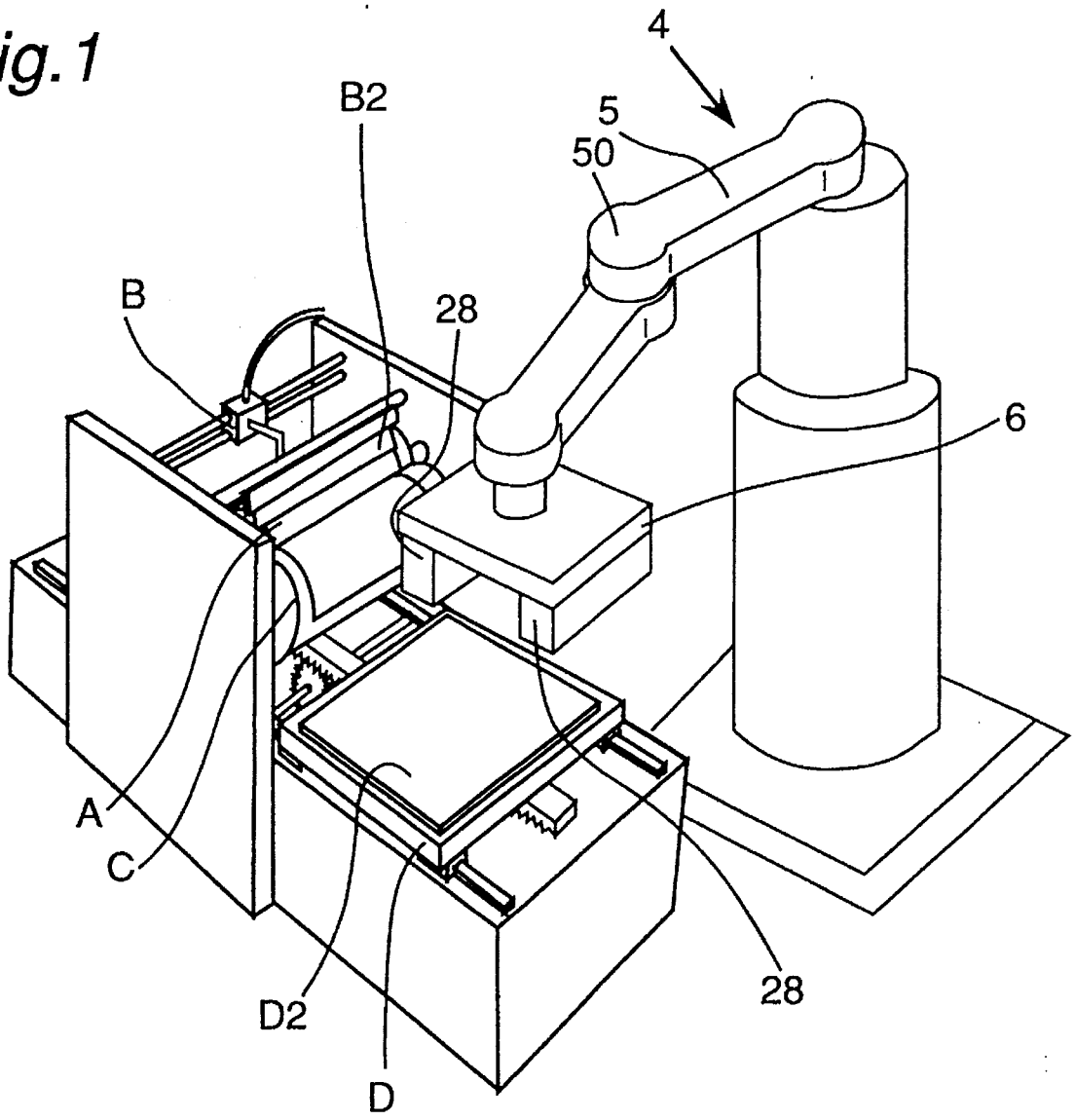
FIG. 1 is a perspective view showing an apparatus, according to an embodiment of the present invention for automatically installing and removing a thin-film forming elastic plate, comprising an articulated robot and a thin-film forming apparatus having a printing roll according to the present invention and using the thin-film forming elastic plate to be installed on the printing roll.

Before the description of the present invention proceeds, it is to be noted that like parts are designated by like reference numerals throughout the accompanying drawings.

An embodiment of the present invention is described below with reference to the drawings.

An automatic elastic plate installing/removing apparatus comprising a thin-film forming apparatus having a printing roll according to an embodiment of the present invention and an articulated robot 4 for installing a thin-film forming elastic plate, according to an embodiment of the present invention, on the printing roll and removing it therefrom has a construction as shown in FIG. 1.

A hand 6 for installing the thin-film forming elastic plate on the printing roll and removing it therefrom is mounted on arms 5 of the articulated robot 4. An industrial robot used widely serves as the articulated robot 4 in which a plurality of the arms 5 movable horizontally and vertically are connected with each other via a joint 50. That is, the articulated robot 4 may be of a horizontally movable type, a vertically movable type, or an orthogonally movable type. The hand 6 is installed at one end of one of the plurality of arms 5. An end of the other of the arms 5 is supported on a robot base. The joint 50 is a portion for driving the arms 5 at a plurality of stages or non-stages by hydraulic pressure, water pressure, or a motor. The robot base is a portion for driving the group of the arms 5 vertically at a plurality of stages or non-stages by hydraulic pressure, water pressure, or a motor.

A thin-film forming elastic plate, according to the present invention, to be installed on the printing roll which is a device of the automatic elastic plate installing/removing apparatus is described below.

Figure 20:
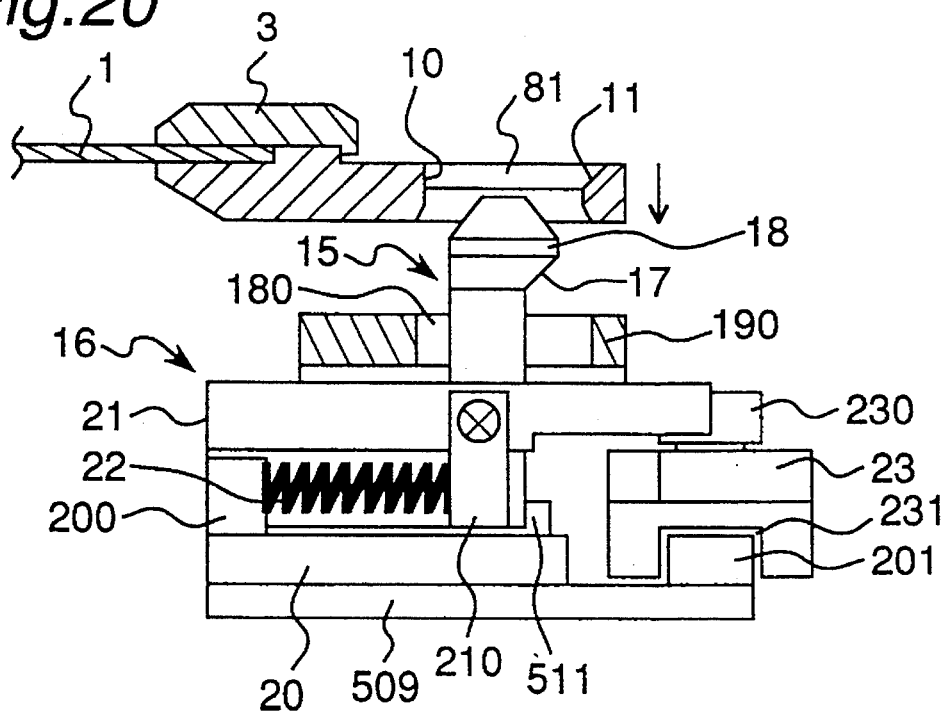
FIG. 20 is a view for describing an elastic plate holder-chucking operation of the second chucking means shown in FIG. 3 and a state in which the elastic plate holder has not been placed on the placing base.
Figure 22:
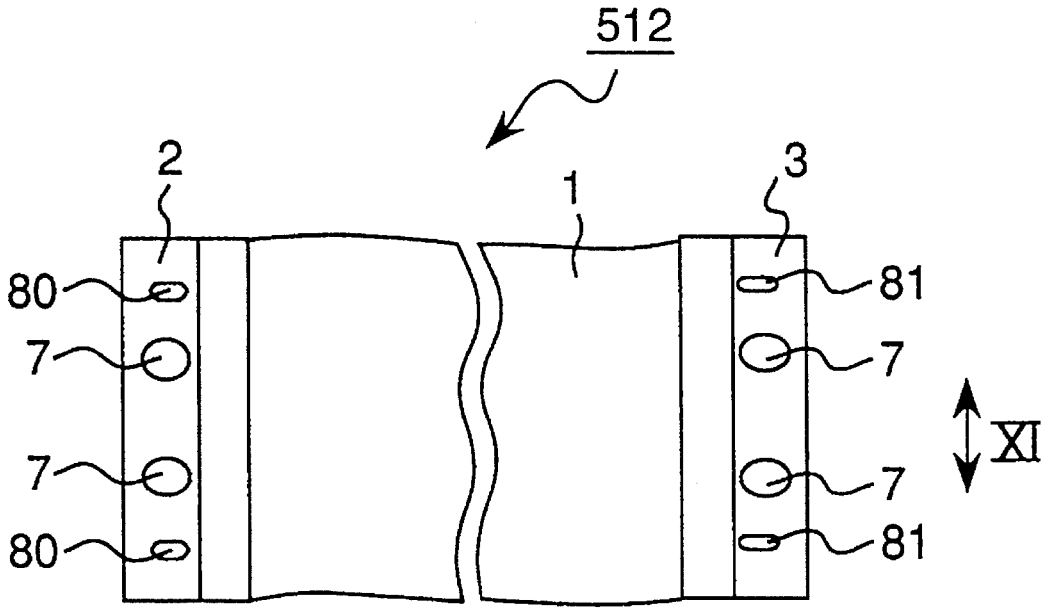
FIG. 22 is a plan view showing a thin-film forming elastic plate according to an embodiment of the present invention.
Figure 23:
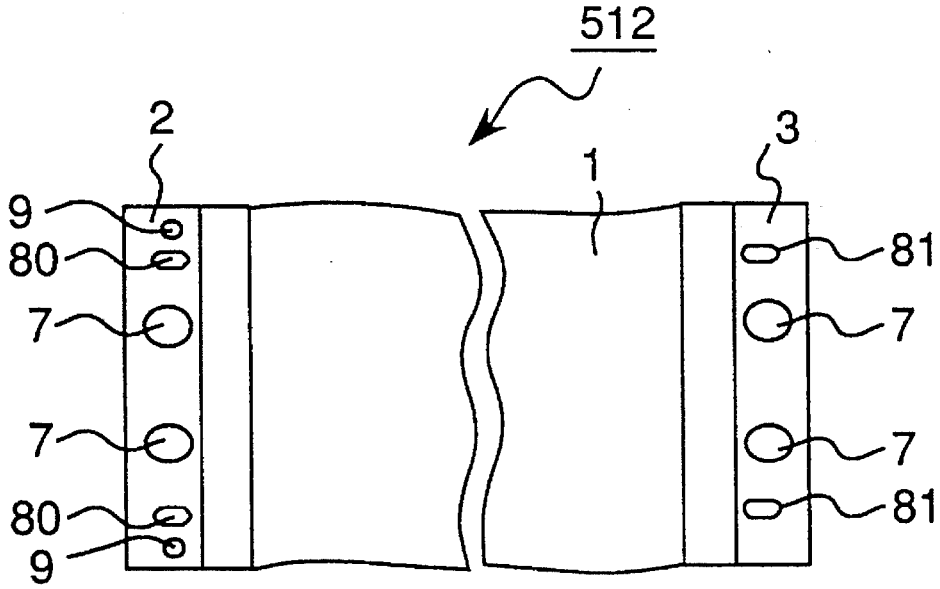
FIG. 23 is a plan view showing the thin-film forming elastic plate, according to another embodiment of the present invention, shown in FIG. 22.

As shown in FIG. 22, a thin-film forming elastic plate 512 comprises an elastic portion 1 to which ink is transferred; a first elastic plate holder 2, for gripping the elastic portion 1 at the leading end thereof wound firstly around the printing roll, installed on the elastic portion 1; and a second elastic plate holder 3, for gripping the elastic portion 1 at the trailing end thereof wound lastly around the printing roll, installed on the elastic portion 1. The first elastic plate holder 2 has a pair of rectangular first printing roll-chucking holes 80 penetrating through the first elastic plate holder 2 in the thickness direction thereof. The second elastic plate holder 3 has a pair of rectangular second printing roll-chucking holes 81 penetrating through the second elastic plate holder 3 in the thickness direction thereof. The first printing roll-chucking holes 80 and the second printing roll-chucking holes 81 are holes to be held by and released from an automatic chucking device provided on a printing roll barrel 503 which is described later. As shown in FIG. 23, as necessary, a pair of positioning holes 9 into which positioning pins 14 provided on the printing roll barrel 503 are inserted may be defined on the first elastic plate holder 2. As shown in FIG. 20, a chucking hole side-tapered surface 11 is formed on an inner wall 10 of each of the second printing roll-chucking holes 81. The tapered surface 11 may be disposed on a part of the inner wall 10 of the second printing roll-chucking holes 81 or on the entire surface of the inner wall 10 and may be flat or curved.

Figure 13:
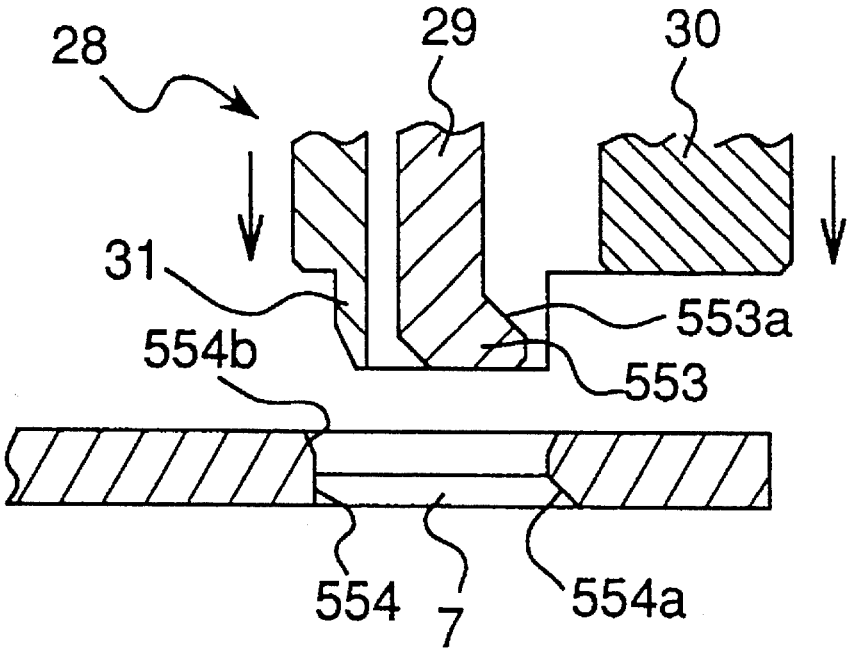
FIG. 13 is a sectional view showing the construction of a claw of the chucking means provided on the hand body shown in FIG. 11 and that of the elastic plate holder.
Figure 14:
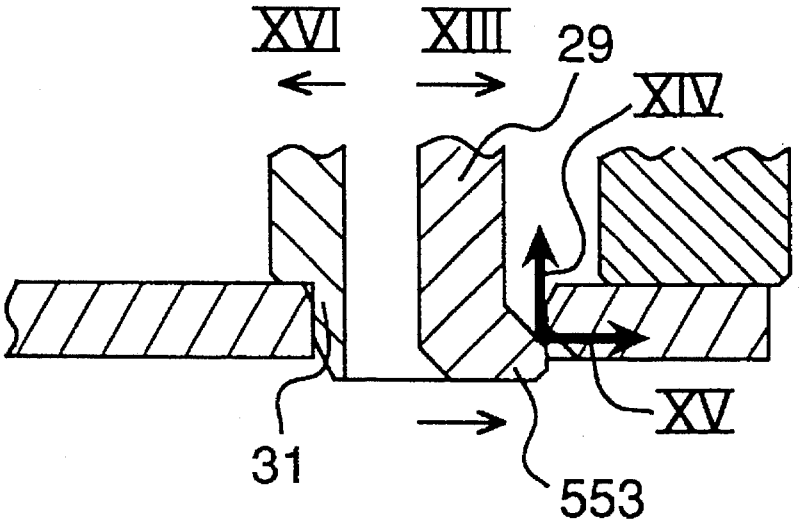
FIG. 14 is a sectional view showing the construction of the chucking means provided on the hand body shown in FIG. 11 and that of the plate holder and a state in which the chucking means has chucked the elastic plate holder.

There is formed, on the first elastic plate holder 2 and the second elastic plate holder 3, a pair of circular hand-chucking holes 7 for holding and releasing the first elastic plate holder 2 and the second elastic plate holder 3 by means of the hand 6 installed on the arm 5 of the articulated robot 4. As shown in FIGS. 13 and 14, of an inner wall 554 of each hand-chucking hole 7, a tapered surface **554*a* extending from the hand side toward the side opposite to the hand 6 is formed on a portion, of the inner wall 554, to be engaged by a claw 553 of a chucking member 29 provided on the hand 6. The tapered surface 554*a* may be disposed on a part of the inner wall 554 of the hand-chucking holes 7 or on the entire surface of the inner wall 554** and may be flat or curved.

Preferably, the inclination of the tapered surface 11 and that of the tapered surface **554*a*** is 45°.

The number of the printing roll-chucking holes 80 and 81 and that of hand-chucking holes 7 are not limited to those shown in the drawings. The printing roll-chucking holes 80 and 81 and the hand-chucking holes 7 may be in any configurations, for example, circular, elliptical, rectangular. The hand-chucking holes 7 may be disposed internally of the printing roll-chucking holes 80 and 81 or externally thereof.

The elastic portion 1 is made of a soft material such as rubber or synthetic resin and may be a letterpress plate in which a convex portion is formed on the surface in a desired pattern, or an intaglio plate or a planographic plate. The first and second elastic plate holders 2 and 3 are made of metal, ceramic, plastic or wood.

The printing roll according to an embodiment of the present invention is described below.

Figure 2:
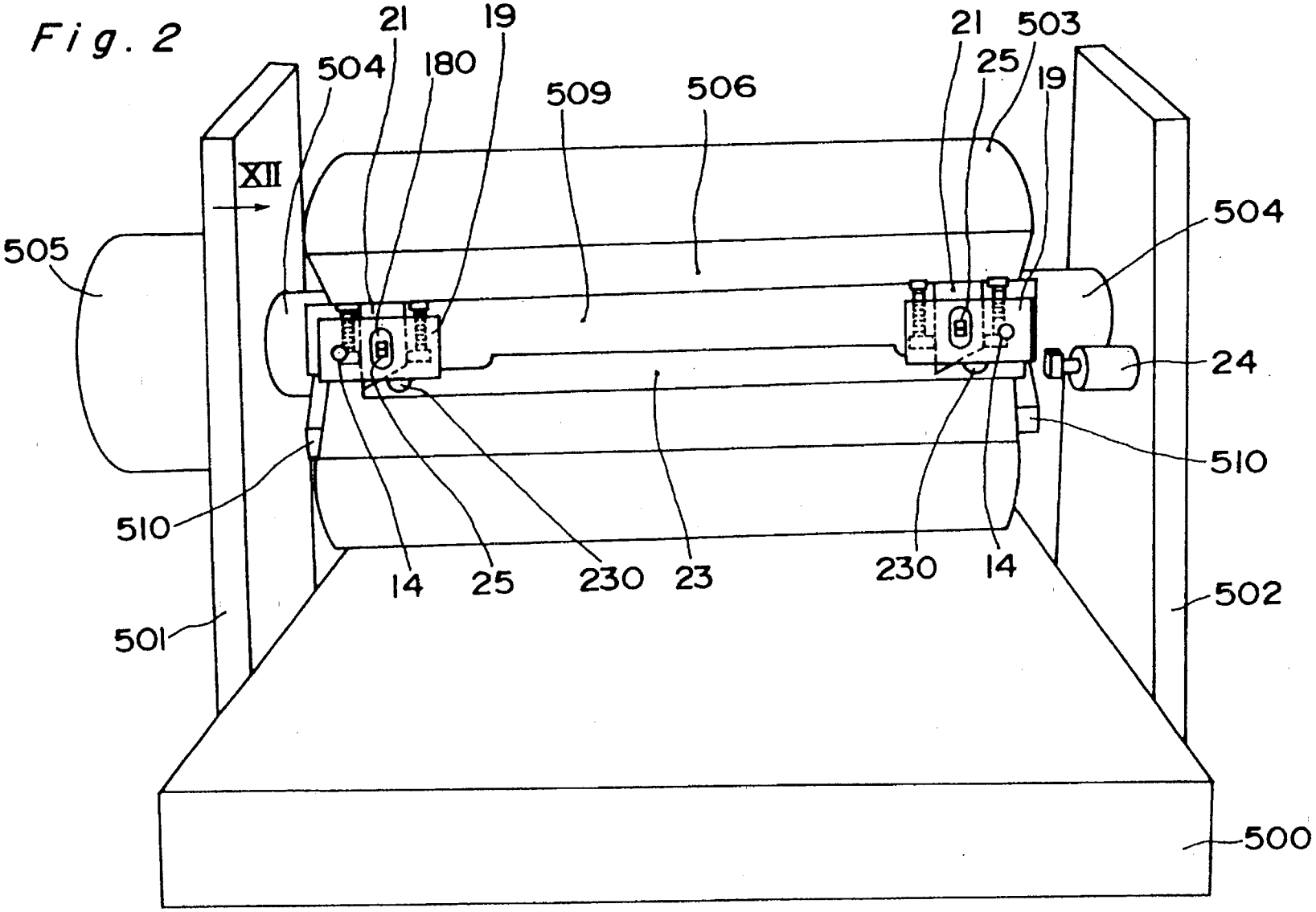
FIG. 2 is a perspective view showing the printing roll according to the embodiment of the present invention and a first chucking means provided on the printing roll.
Figure 3:
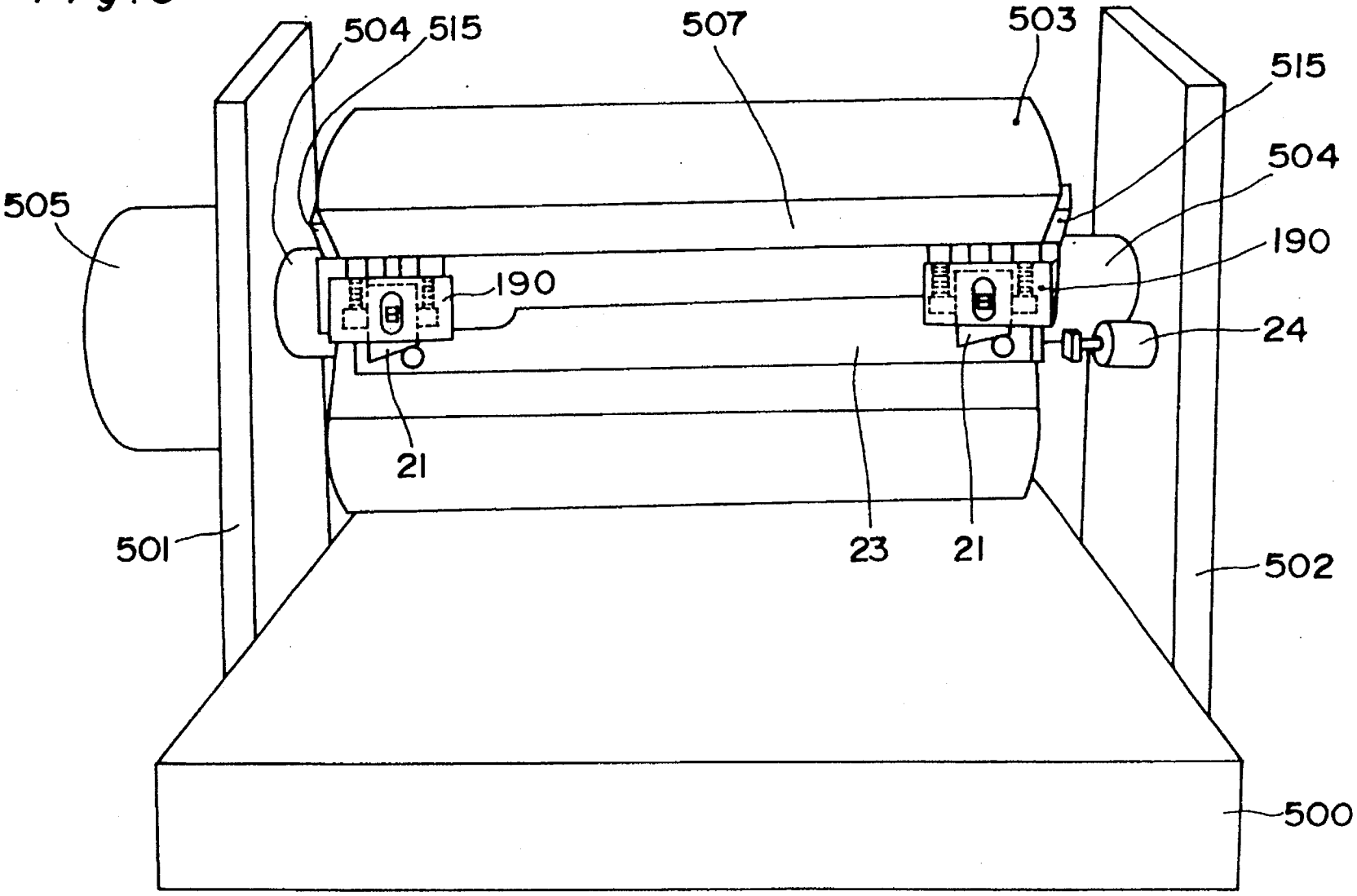
FIG. 3 is a perspective view showing the printing roll according to the embodiment of the present invention and a second chucking means provided on the printing roll.

As shown in FIGS. 2 and 3, the printing roll comprises the approximately cylindrical printing roll barrel 503 having a rotary shaft 504 of which projects from both ends thereof. The printing roll barrel 503 is sandwiched between a pair of supporting frames 501 and 502, with the rotary shaft 504 rotatably supported by the frames 501 and 502. A driving motor 505 is installed on the supporting frame 501 and drives the printing roll barrel 503 so that it rotates in the circumferential direction thereof on the rotary shaft 504.

Figure 4:
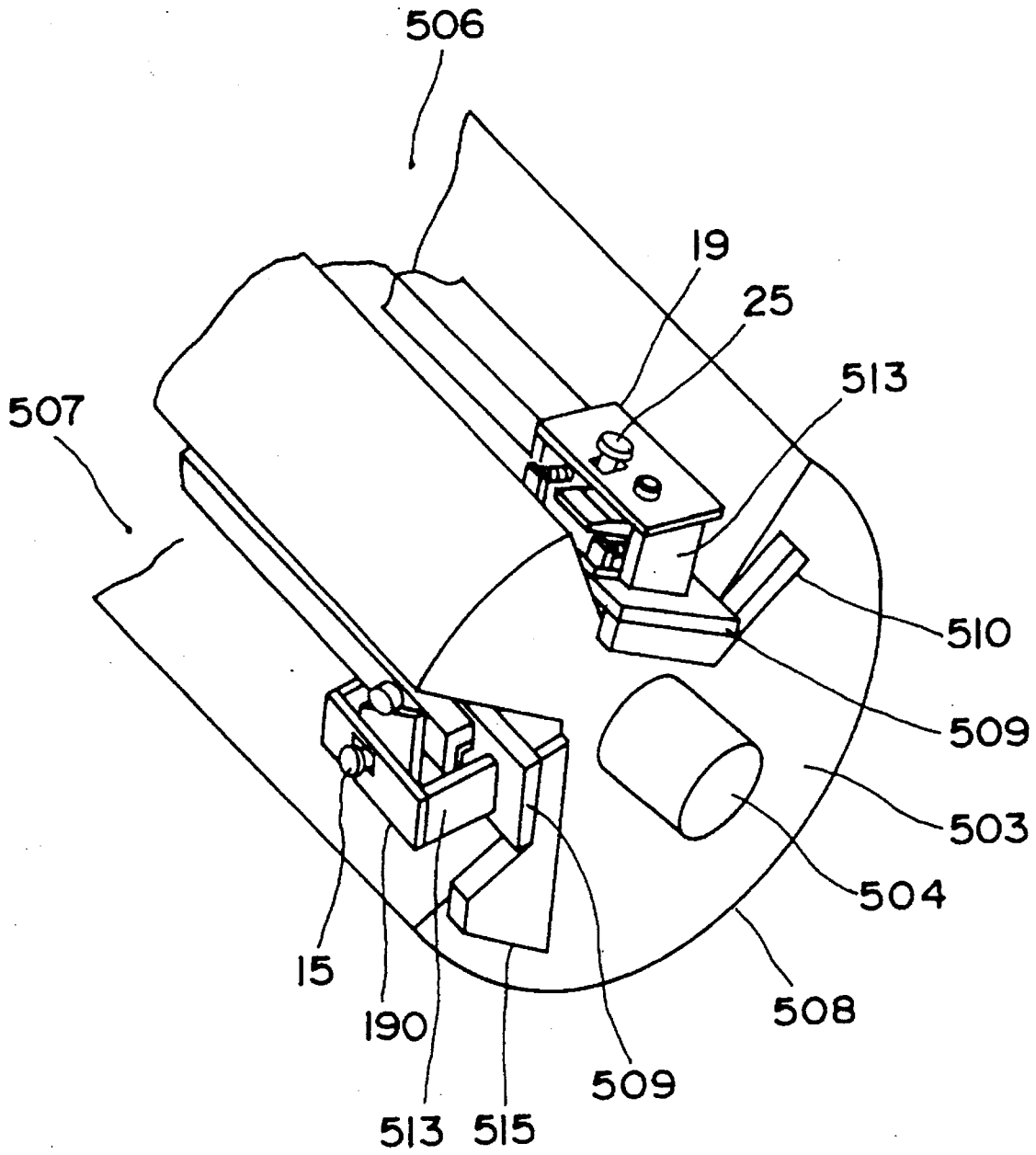
FIG. 4 is a perspective view showing a printing roll barrel viewed in a direction shown by an arrow XII shown in FIG. 2.

As shown in FIG. 4, grooves 506 and 507 extending in the axial direction of the printing roll barrel 503 are formed at two portions in the circumferential direction thereof. The grooves 506 and 507 are spaced from each other at an interval corresponding to 270° in the clockwise direction. A first chucking means 12 (FIG. 5) for installing the first elastic plate holder 2 of the thin-film forming elastic plate 512 on the printing roll barrel 503 and removing it therefrom is provided in the groove 506. A second chucking means 13 (FIG. 6) for installing the second elastic plate holder 3 of the thin-film forming elastic plate 512 on the printing roll barrel 503 and removing it therefrom is provided in the groove 507.

Figure 29:
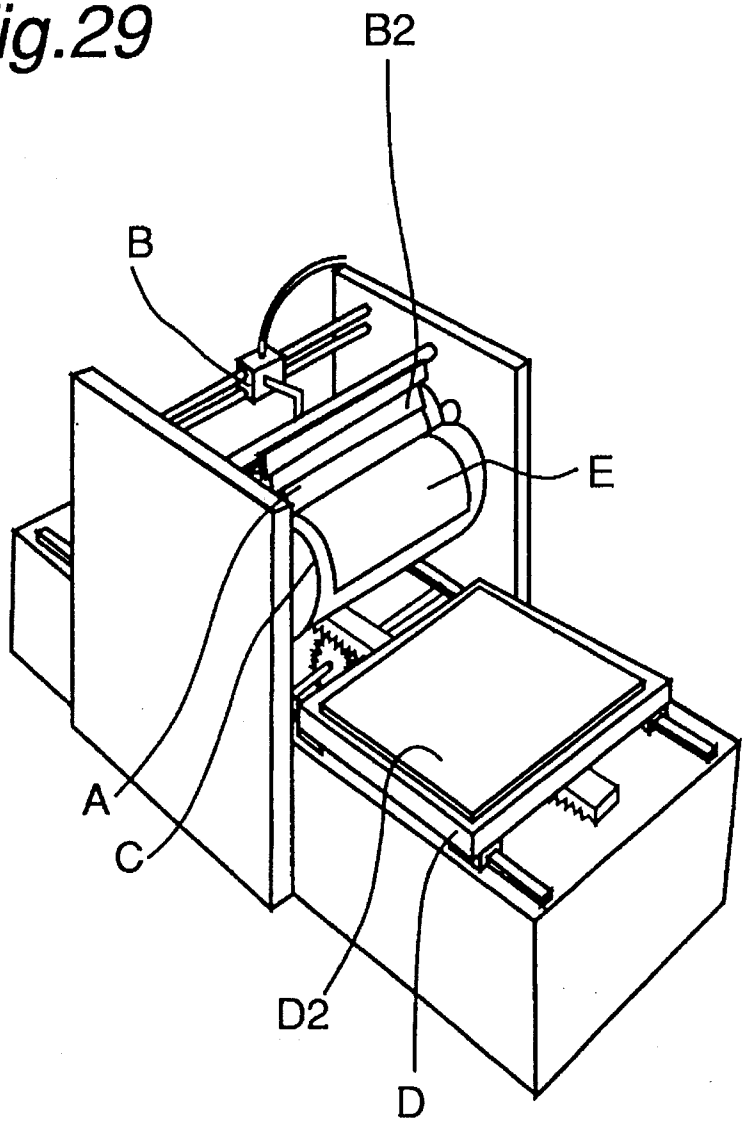
FIG. 29 is perspective view showing a conventional thin-film forming apparatus.

After the first elastic plate holder 2 of the thin-film forming elastic plate 512 is held by the first chucking means 12, the thin-film forming elastic plate 512 is moved toward the second chucking means 13 spaced from the first elastic plate holder 2 at an interval corresponding to 270° and wound along the circumferential surface of the printing roll barrel 503, namely, along the circumferential surface shown by reference numeral 508 in FIG. 4, and then, the second elastic plate holder 3 is held by the second chucking means 13. The printing roll barrel 503 on which the thin-film forming elastic plate 512 has been installed contacts an intaglio roll (A) and a to-be-printed material D2, thus transferring ink transferred from the barrel of the intaglio roll (A) to the thin-film forming elastic plate 512 and then to the to-be-printed material D2, as shown in FIG. 29.

Figure 5:
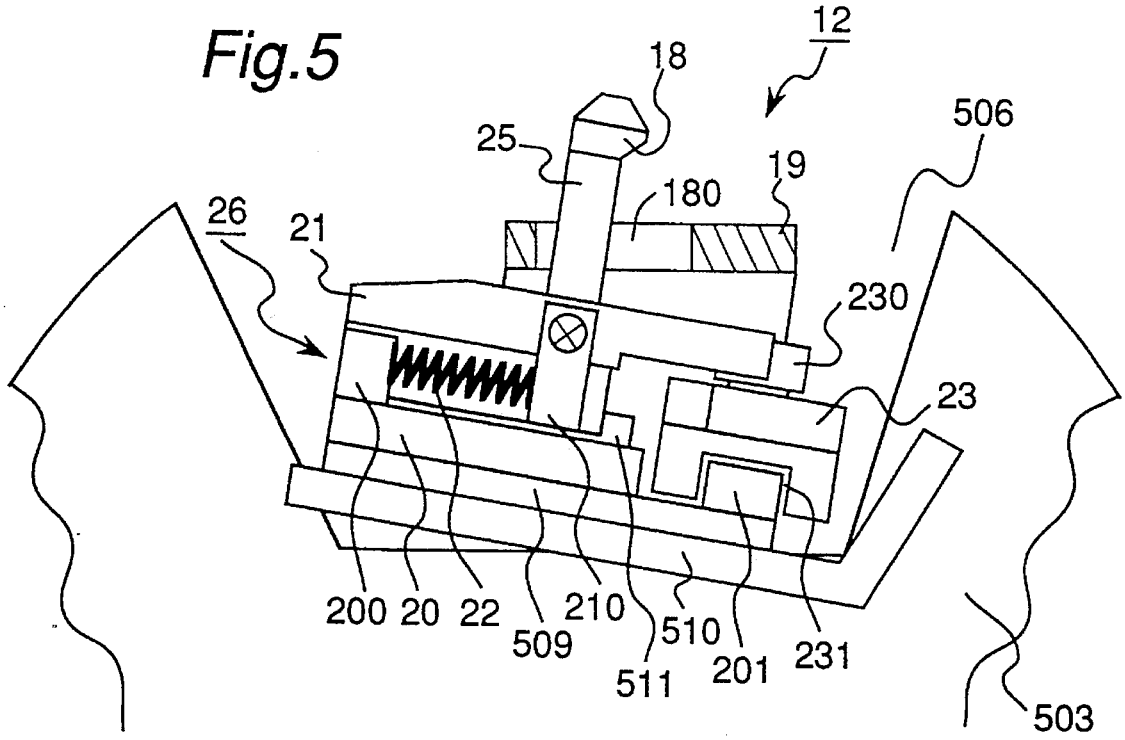
FIG. 5 is a side view showing the first chucking means shown in FIG. 2.

The first chucking means 12 is described below with reference to FIGS. 2, 5 and other drawings.

The first chucking means 12 comprises a first placing base 19 for fixing the first elastic plate holder 2 thereto; a first chucking member 25; and a first driving portion 26 for driving the first chucking member 25. The number of the first chucking members 25 and that of the first driving portions 26 correspond to that of the first printing roll-chucking holes 80 formed on the first elastic plate holder 2 of the thin-film forming elastic plate 512. In this embodiment, a first placing base 19 and a first chucking member 25 are disposed at each end of the printing roll barrel 503.

The first chucking means 12 is installed in the groove 506 of the printing roll barrel 503 as follows: That is, as shown in FIGS. 4 and 5, a base plate-installing member 510 is fixed to both ends of the groove 506 formed on the printing roll barrel 503. The base plate-installing member 510 is provided to support and fix both ends of a first base plate 509 extending along the groove 506 and inclines at a predetermined angle so that the first base plate 509 extends with a downward slope along the clockwise direction with respect to a tangent to the circumferential surface of the printing roll barrel 503. The first chucking means 12 is installed on the first base plate 509 thus fixed to the printing roll barrel 503.

A slide guide 201, an example of a second guide member, extending in the axial direction of the printing roll barrel 503 along one side of the first base plate 509 in the lengthwise direction of the first base plate 509 is fixed to the first base plate 509. A second slider 23 having a guide groove 231 receiving the slide guide 201 and sliding along the slide guide 201 in contact therewith is provided on the slide guide 201. A cam follower 230 is rotatably installed on the upper surface of the second slider 23. The second slider 23 is driven by a driving shaft of a cylinder 24, serving as a driving device such as an air cylinder, an oil cylinder, etc., installed on the supporting frame 502. The second slider 23 and the cylinder 24 are constituent components of the first driving portion 26 which will be described below.

The first placing base 19, the first chucking member 25, and the first driving portion 26 of the first chucking means 12 are described below.

Figure 7:
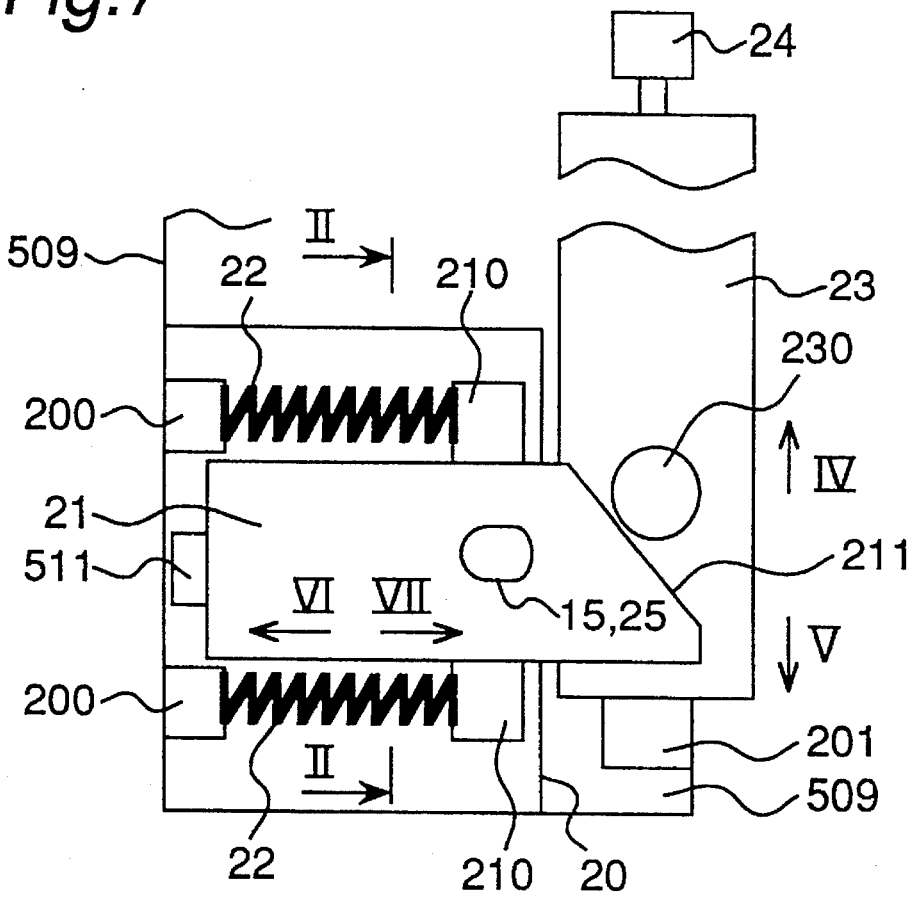
FIG. 7 is a plan view showing the first chucking means shown in FIG. 5 or the second chucking means shown in FIG. 6.
Figure 8:
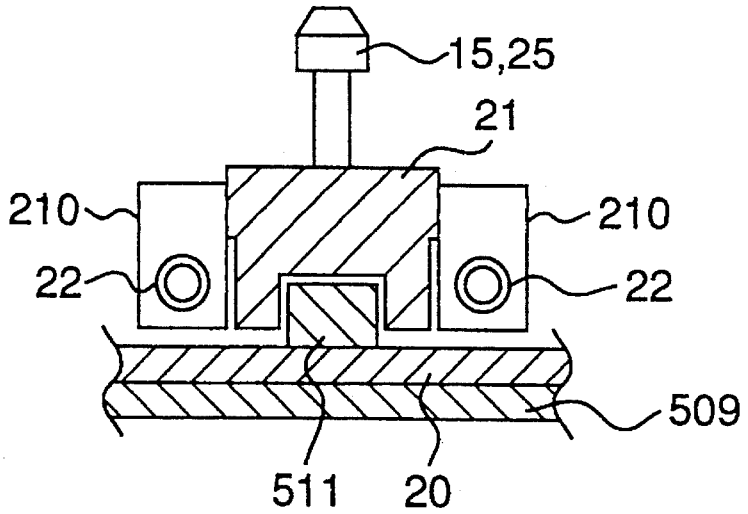
FIG. 8 is a sectional view taken along a line II—II shown in FIG. 7.

In addition to the second slider 23, etc., the first driving portion 26 has a second base plate 20, a first slider 21, and a compression spring 22. As shown in FIG. 7, a second base plate 20 is fixed to each end, of the first base plate 509, at a position at which the second base plate 20 does not interfere with the second slider 23. As shown in FIGS. 5, 7, and 8, a guide 511, an example of the first guide member, extending in a direction orthogonal to the movement direction of the second slider 23 is fixed to the second base plate 20. The first slider 21 sliding along the guide 511 in contact and engagement therewith is installed on the guide 511. The first chucking member 25 is erected on the upper surface of the first slider 21. Accordingly, together with the first slider 21, the first chucking member 25 moves in a direction orthogonal to the movement direction of the second slider 23. One end of the first slider 21 is extended to an upper portion of the second slider 23 so that the first slider 21 contacts the cam follower 230 provided on the second slider 23, and as shown in FIG. 7, an inclined surface 211 is formed on the first slider 21 so that the first slider 21 moves in a direction shown by an arrow VI when the second slider 23 moves in a direction shown by an arrow V. The inclined surface 211 is always urged toward the cam follower 230 by the elastic force of the compression spring 22 interposed between a spring-fixing member 200 erected on the second base plate 20 and a spring-fixing member 210 fixed to the first slider 21.

The first chucking member 25 has a claw 18 which applies a force for pressing an opening edge 27 of the first printing roll-chucking hole 80 formed in the first elastic plate holder 2 of the thin-film forming elastic plate 512 toward the first placing base 19 vertically.

Figure 15:
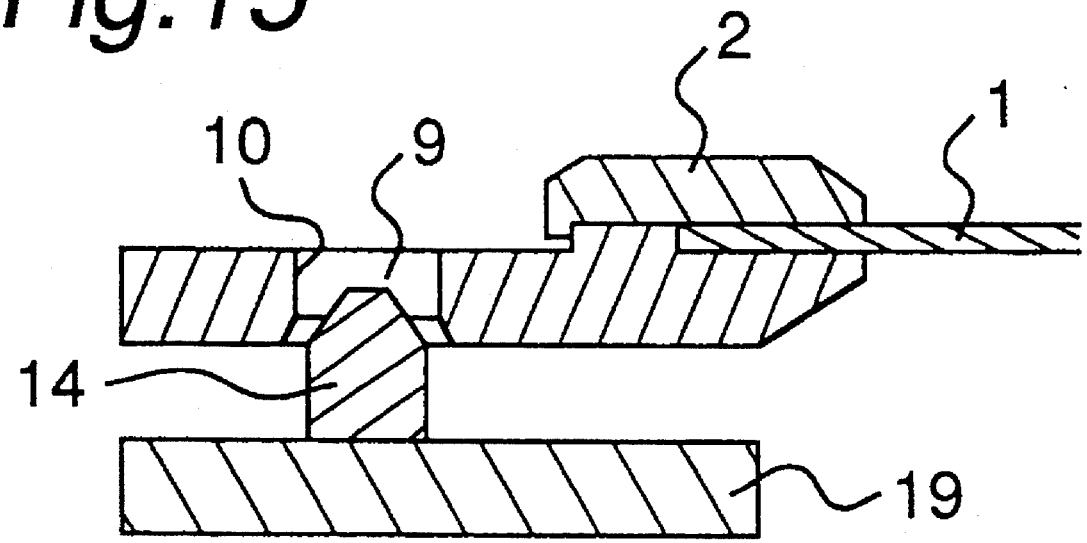
FIG. 15 is a sectional view showing the construction of a positioning pin of the first chucking means shown in FIG. 2 and that of the plate elastic holder.
Figure 16:
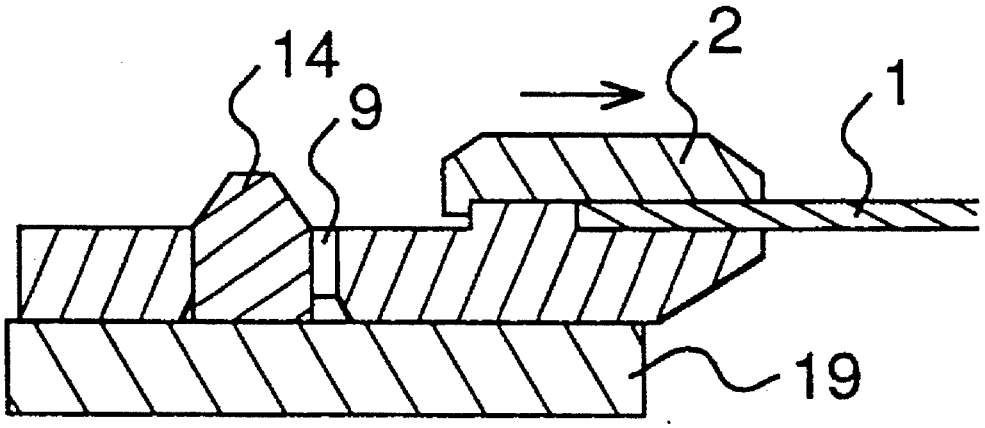
FIG. 16 is a sectional view showing the construction of a positioning pin of the first chucking means shown in FIG. 2 and that of the elastic plate holder and a state in which the plate holder has engaged the positioning pin.

The first placing base 19 has a through-hole 180 through which the first chucking member 25 penetrates and is supported by a pair of supporting frames 513 erected on the first base plate 509 or the second base plate 20 such that the first placing base 19 almost covers the first slider 21, as shown in FIG. 4. As shown in FIGS. 2, 15, and 16, a pair of positioning pins 14 for setting the installing position of the thin-film forming elastic plate 512 on the printing roll barrel 503 may be erected on the upper surface of the first placing base 19.

As described above and shown in FIG. 5, because the first base plate 509 of the first chucking means 12 is inclined, the first slider 21 and the first chucking member 25 are inclined in accordance therewith, whereas the first placing base 19 is disposed in parallel with a tangent to the circumferential surface of the printing roll barrel 503. The reason the first base plate 509 is inclined and the first placing base 19 is not inclined but disposed in parallel with the tangent is so that a downward force in a direction shown by an arrow VIII of FIG. 19 will be generated in the opening edge 27 of each of first printing roll-chucking holes 80 by the claw 18 of the first chucking member 25. However, if a downward force can be generated by the first chucking member 25 by using any other method, the first base plate 509 does not have to be inclined.

FIGS. 7 and 8 are drawings used to describe the first chucking means 12 and the second chucking means 13 which will be described later and the constructions shown in FIGS. 7 and 8 are a little different from that shown in FIG. 5. In FIGS. 7 and 8, the first and second placing bases 19 and 190 are not shown.

The first chucking member 25, the first driving portion 26, and the first elastic plate holder 2 installed on the first placing base 19 act on each other as follows (refer to FIGS. 7 and 17 through 19).

That is, as described above, the inclined surface 211 of the first slider 21 is always pressed against the cam follower 230 by the compression spring 22. The second slider 23 is pressed by driving the cylinder 24 in a direction shown by an arrow (V) of FIG. 7 to move the second slider 23 along the slide guide 201, and then the cam follower 230 of the second slider 23 presses the inclined surface 211 of the first slider 21. Due to this pressing force, the first slider 21 is moved in a direction shown by an arrow (VI) against the resiliency of the compression spring 22 while the first slider 21 is being guided by the guide 511. Because the first chucking member 25 is fixed to the first slider 21, the first chucking member 25 moves in the direction shown by the arrow (VI) as well in accordance with the movement of the first slider 21.

When the second slider 23 is pressed by only a small force generated by the cylinder 24, the first slider 21 is moved in a direction shown by an arrow VII due to the resiliency of the compression spring 22 while the second slider 23 moves in a direction shown by an arrow IV. Because the first chucking member 25 is inclined relative to the first placing base 19, the first chucking member 25 can be moved in a lower right direction in FIG. 18, namely, an oblique direction with respect to the printing roll barrel 503. As a result, as shown in FIG. 19, the claw 18 of the first chucking member 25 presses the opening edge 27 of each of the first printing roll-chucking holes 80 formed on the first elastic plate holder 2 in the direction shown by the arrow VIII. The force shown by the arrow VIII pressing the opening edge 27 downward acts as a force sandwiching the first elastic plate holder 2 between the first chucking member 25 and the first placing base 19 in cooperation with the first placing base 19.

When the second slider 23 is pressed, by the cylinder 24, with a force stronger than the resiliency of the compression spring 22, the first slider 21 moves in the direction shown by the arrow VI of FIG. 19 against the resiliency of the compression spring 22. As a result, the claw 18 of the first chucking member 25 moves apart from the opening edge 27 of the first elastic plate holder 2 and consequently, the force for fixing the first elastic plate holder 2 to the first placing base 19 is released.

Figure 6:
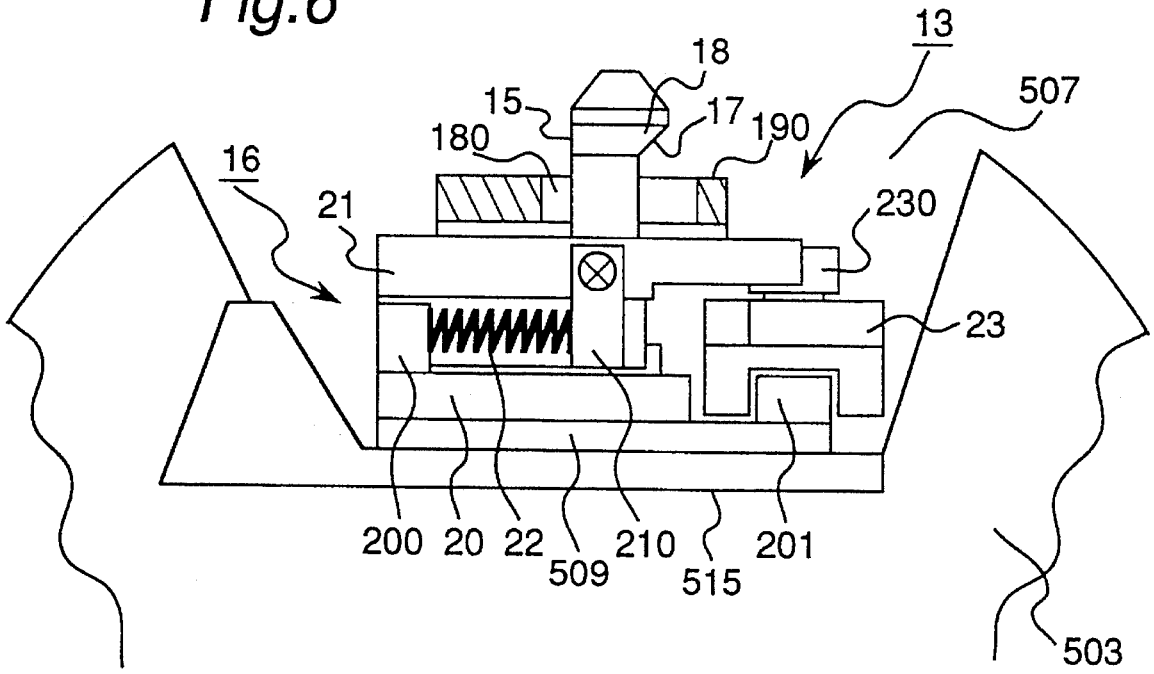
FIG. 6 is a side view showing the second chucking means shown in FIG. 3.

The second chucking means 13 is described below with reference to FIGS. 3, 6, and other drawings.

Similarly to the first chucking means 12, the second chucking means 13 comprises the second placing base 190 for fixing the second elastic plate holder 3 thereto; a second chucking member 15; and a second driving portion 16 for driving the second chucking member 15. The second chucking member 15 is provided in correspondence with the number of the second printing roll-chucking holes 81 provided on the second elastic plate holder 3 of the thin-film forming elastic plate 512.

Similarly to the first chucking means 12, the second chucking means 13 is installed in the groove 507 of the printing roll barrel 503 as described below. That is, as shown in FIGS. 4 and 6, a base plate-installing member 515 is fixed at both ends of the groove 506 of the printing roll barrel 503. The base plate-installing member 515 is provided to support and fix both ends of the first base plate 509 extending along the groove 507. The second chucking means 13 is installed on the first base plate 509 and is thus fixed to the printing roll barrel 503. Unlike the first chucking means 12, in the second chucking means 13, the first base plate 509 is not inclined. Similarly to the first chucking means 12, the slide guide 201 and the second slider 23 having the cam follower 230 are provided on the first base plate 509, and the second slider 23 is driven by the driving shaft of the cylinder 24. The second slider 23 and the cylinder 24 are constituent members of the second driving portion 16 which will be described below.

The second chucking member 15 and the second driving portion 16 are described below.

Similarly to the first driving portion 26, the second driving portion 16 has the second base plate 20; the first slider 21; and the compression spring 22 in addition to the second slider 23. Because the construction and disposition of the second driving portion 16 are similar to those of the first driving portion 26, the descriptions thereof are omitted herein. The second chucking member 15 of the second chucking means 13 is erected on the upper surface of the first slider 21 and thus, the second chucking member 15 moves in a direction orthogonal to the movement direction of the second slider 23 together with the first slider 21.

The second chucking member 15 has the claw 18 which a chucking member side-tapered surface 17 corresponding to the tapered surface 11 of each of the second printing roll-chucking holes 81 formed on the second elastic plate holder 3 of the thin-film forming elastic plate 512 has been formed. The tapered surface 17 may be flat or curved. When the tapered surface 17 is flat, preferably, the inclination thereof is 45°.

Because the second placing base 190 has the same construction and disposition as those of the placing base of the first chucking means 12, the descriptions thereof are omitted herein. However, a positioning pin is not provided on the second placing base 190 of the second chucking means 13.

Figure 21:
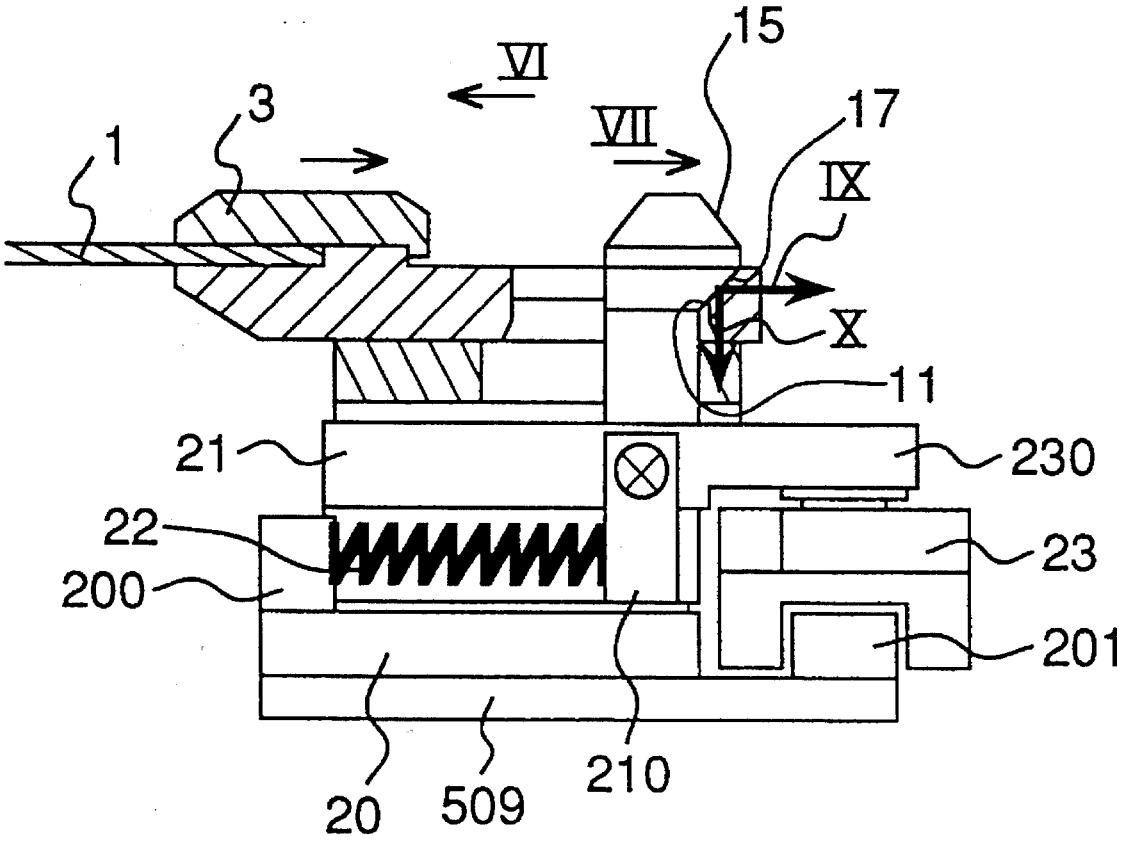
FIG. 21 is a view for describing the elastic plate holder-chucking operation of the second chucking means shown in FIG. 3 and a state in which the elastic plate holder has been placed on the placing base by being chucked by the second chucking means.

As shown in FIGS. 20 and 21, the second chucking member 15, the second driving portion 16, and the second elastic plate holder 3 set on the second placing base 190 have actions similar to those to be performed by the corresponding members of the first chucking means 12. Therefore, the description of the operation to be performed by the second chucking member 15 is omitted herein except for the description of the operation of fixing the second elastic plate holder 3 to the second placing base 190 and removing it therefrom.

After the second slider 23 is pressed by driving the cylinder 24, the pressing force generated by the cylinder 24 is reduced. As a result, the first slider 21 moves in a direction shown by an arrow VII of FIG. 21, and the tapered surface 17 of the second chucking member 15 presses the tapered surface 11 of each of the second printing roll-chucking holes 81 of the second elastic plate holder 3. Because the portion being pressed is the tapered surface 11, the force pressing the second elastic plate holder 3 is resolved into a downward force shown by an arrow X of FIG. 21 and a force, acting toward the right, shown by an arrow IX.

The downward force shown by the arrow X serves as a force for sandwiching the second elastic plate holder 3 between the second chucking member 15 and the second placing base 190 in cooperation with the second placing base 190, thus fixing the second elastic plate holder 3 to the second placing base 190 such that the printing roll barrel 503 and the thin-film forming elastic plate 512 are dislocated from each other vertically. The force, acting toward the right, shown by the arrow IX serves as a force for pulling the elastic portion 1 to the right, thus fixing the second elastic plate holder 3 to the second placing base 190 such that the printing roll barrel 503 and the thin-film forming elastic plate 512 are dislocated from each other horizontally.

The ratio between the downward force shown by the arrow X and the force, acting toward the right, shown by the arrow IX depends on the inclination of the tapered surface 11 of each of the second printing roll-chucking holes 81 formed on the second elastic plate holder 3 and that of the tapered surface 17 of the second chucking member 15. For example, if the inclinations thereof are great, the downward force shown by the arrow X becomes smaller, while the force, acting toward the right, shown by the arrow IX becomes larger.

When the second slider 23 is pressed, by driving the cylinder 24, with a force greater than the resiliency of the compression spring 22, the first slider 21 moves leftward as shown by an arrow VI against the resiliency of the compression spring 22, and the tapered surface 17 of the second chucking member 15 and the tapered surface 11 of the second elastic plate holder 3 move apart from each other. As a result, the force for fixing the second elastic plate holder 3 to the second placing base 190 is released.

The hand of the articulated robot 4 for gripping the first elastic plate holder 2 of the thin-film forming elastic plate 512 and the second elastic plate holder 3 thereof is described below.

Figure 9:
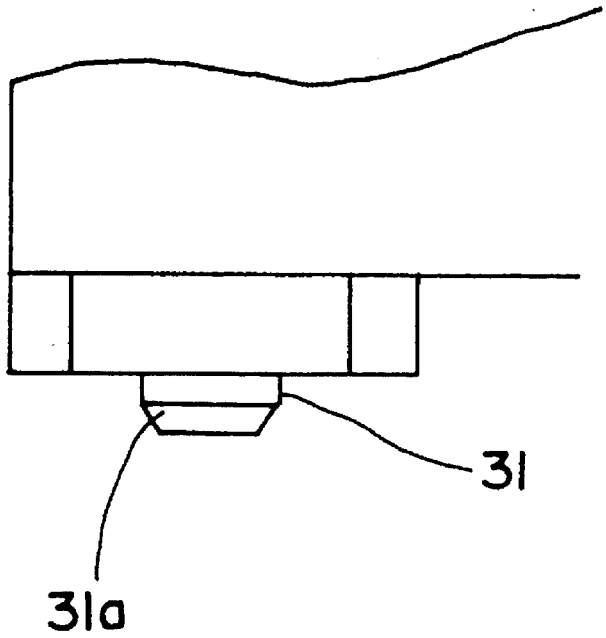
FIG. 9 is a side view showing an elastic plate holder-installing portion of a chucking means provided on a hand body of an articulated robot constituting the apparatus, for automatically installing and removing the elastic plate, shown in FIG. 1.
Figure 10:
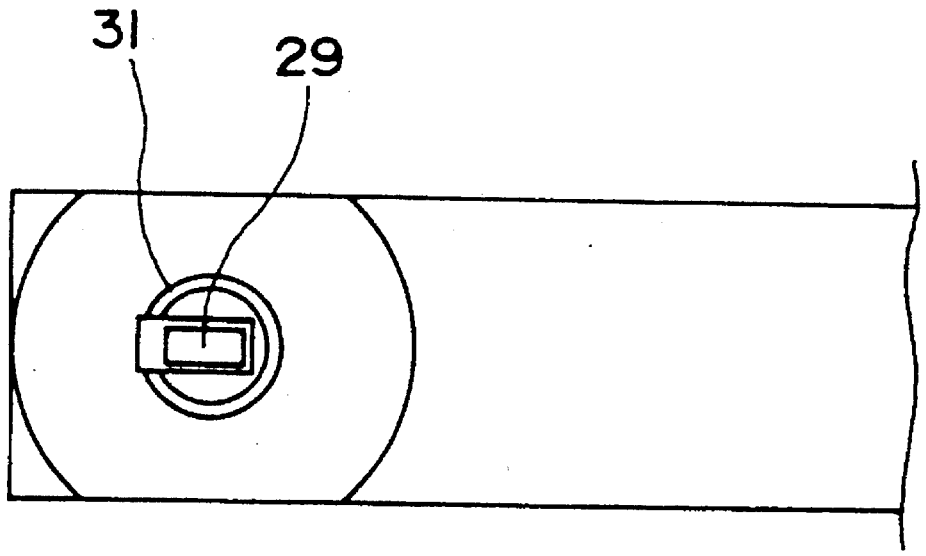
FIG. 10 is a rear view of FIG. 9.

As shown in FIGS. 9 and 10, an insertion portion 31 engaging each of the hand-chucking holes 7 defined on the first elastic plate holder 2 and the second elastic plate holder 3 is formed on a lower surface of a frame of the main body of the hand 6. A tapered portion 31*a* is defined on each of the insertion portions 31 to facilitate the penetration of each of the insertion portions 31 into each of the hand-chucking holes 7. The claw 553 (FIG. 11) forming one end of each of the chucking members 29 is positioned inside the insertion portion 31 so that each of the claws 553 holds the first elastic plate holder 2 and the second elastic plate holder 3 on the lower surface of the frame of the hand main body, with each of the claws 553 being inserted into each of the hand-chucking holes 7. As shown in FIGS. 13 and 14, a tapered surface 553*a* corresponding to the tapered surface 554*a* formed on each of the hand-chucking holes 7 of the first elastic plate holder 2 and the second elastic plate holder 3 is formed on each of the claws 553. On the approach side of the insertion portion 31 in each of the hand-chucking holes 7, an inclined surface 554*b* is defined on the entire wall surface of each of the hand-chucking holes 7 so as to facilitate the penetration of the insertion portion 31 thereinto.

Figure 11:
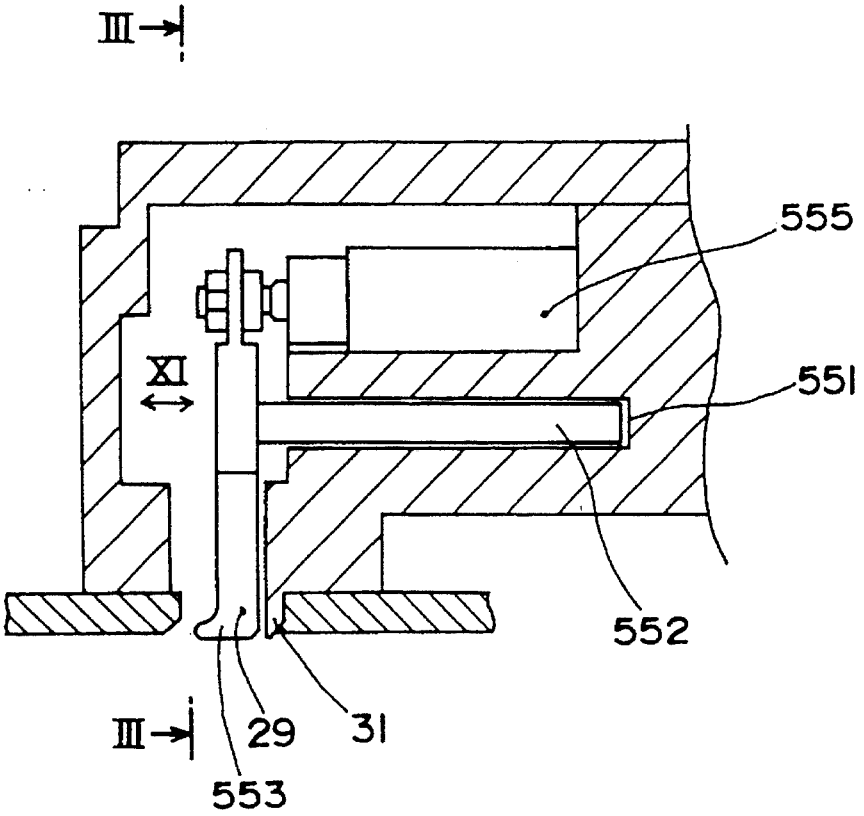
FIG. 11 is a sectional view showing the construction of the chucking means provided on the hand body shown in FIG. 9.
Figure 12:
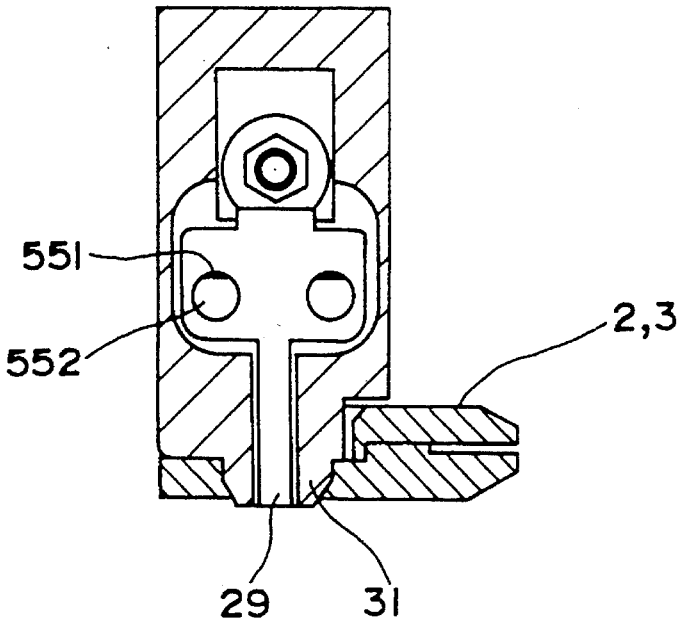
FIG. 12 is a sectional view taken along a line III—III of FIG. 11.

The chucking member 29 moves in a direction shown by an arrow XI of FIG. 22. As shown in FIGS. 11 and 12, the chucking member 29 is supported by a pair of shafts 552 inserted into a pair of guide holes 551 formed inside the hand main body. A driving shaft of an air cylinder 555 for moving the chucking member 29 in the direction shown by the arrow XI is connected with the other end of the chucking member 29. The guide holes 551, the shafts 552, and the air cylinder 555 constitute a driving portion 30 while the chucking member 29 and the driving portion 30 constitute a chucking means 28. The chucking means 28 is provided at a plurality of positions of the hand 6 in correspondence with the number of the hand-chucking holes 7 formed on the thin-film forming elastic plate 512.

As shown in FIGS. 13 and 14, in the chucking means 28, the tapered surface 553*a* of the chucking member 29 and the tapered surface 554*a* of each of the hand-chucking holes 7 become in contact with or in sliding contact with each other as a result of inserting the insertion portion 31 into each of the hand-chucking holes 7 and operating the air cylinder 555 so as to move the chucking member 29 in a direction shown by an arrow XIII. As a result, a force in a direction shown by an arrow XIV and a force in a direction shown by an arrow XV act on the first elastic plate holder 2 and the second elastic plate holder 3. The first elastic plate holder 2 and the second elastic plate holder 3 are fixed to the hand 6 due to the force in the direction shown by the arrow XIV. The first elastic plate holder 2 and the second elastic plate holder 3 are removed from the hand 6 by operating the air cylinder 555 so as to move the chucking member 29 in the direction shown by an arrow XVI.

A control device for controlling the printing roll and the hand 6 of the articulated robot 4 is described below.

Figure 28:
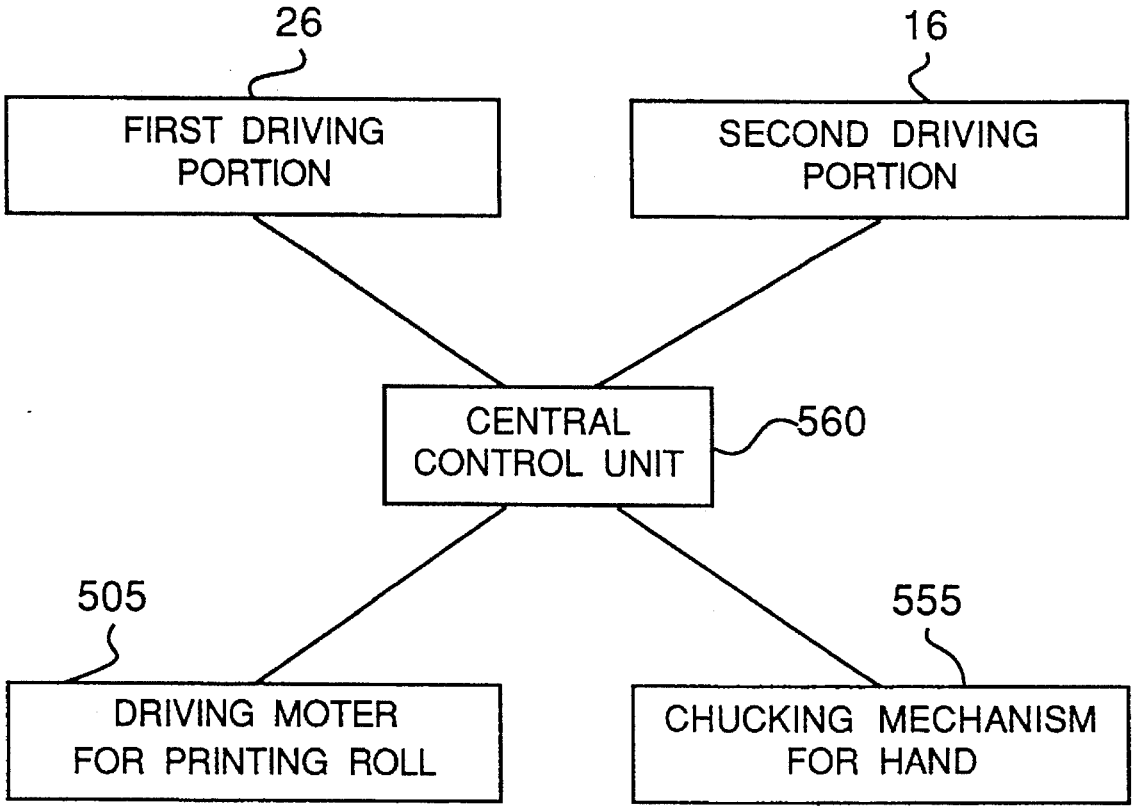
FIG. 28 is a block diagram showing a section for controlling the operation of the apparatus shown in FIG. 1.

As shown in FIG. 28, a central control unit 560 is connected with the driving motor 505 for rotating the printing roll barrel 503; the cylinder 24 for driving the first driving portion 26 of the first chucking means 12 and the second driving portion 16 of the second chucking means 13; and the air cylinder 555 of the hand 6 of the articulated robot 4. The driving motor 505 and the other devices are operated by the control of the central control unit 560.

An operation of fixing the thin-film forming elastic plate 512 to the printing roll barrel 503 by using the printing roll and the thin-film forming elastic plate 512, according to this embodiment, having the above-described construction is described below. In an example described below, the first placing base 19 constituting the first chucking means 12 has the positioning pin 14, and the thin-film forming elastic plate 512 has the positioning hole 9 formed on the first elastic plate holder 2 in correspondence to the provision of the positioning pin 14.

Figure 24:
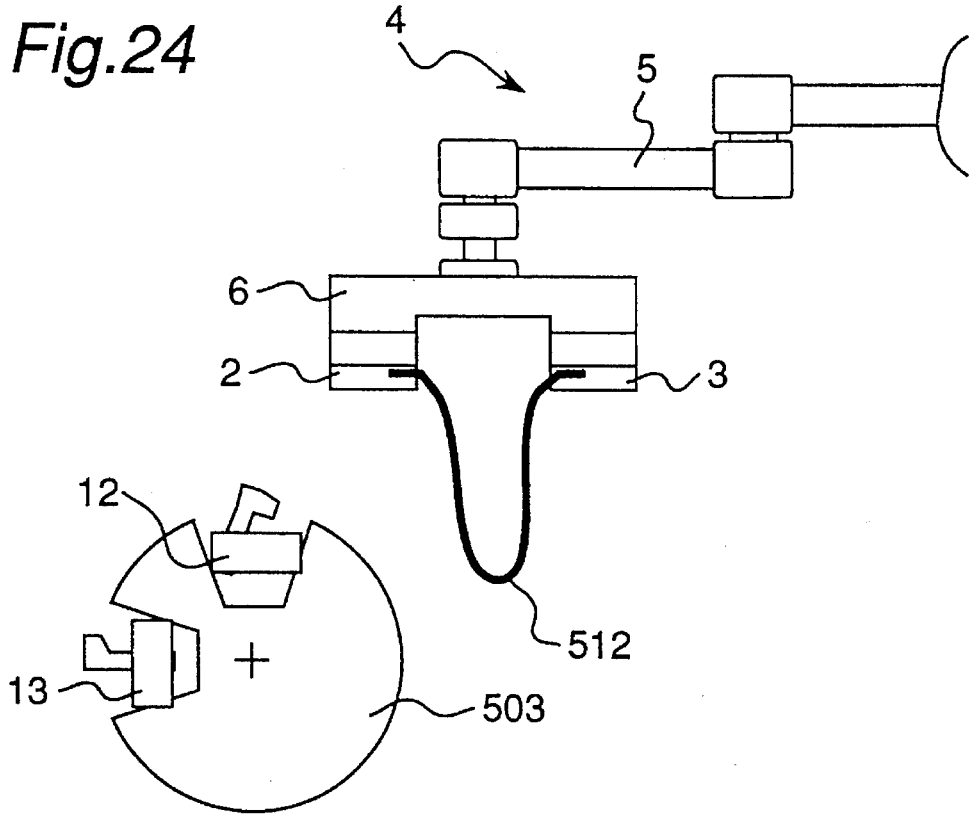
FIG. 24 is a view for describing an operation of installing a thin-film forming elastic plate on a printing roll barrel by using the printing roll and the thin-film forming elastic plate according to the present invention and a state in which the installation of the thin-film forming elastic plate on the printing roll barrel has not been started.

As shown in FIG. 24, the chucking means 28 of the hand 6 holds the first elastic plate holder 2 and the second elastic plate holder 3 of the thin-film forming elastic plate 512 which has been slackened.

Figure 17:
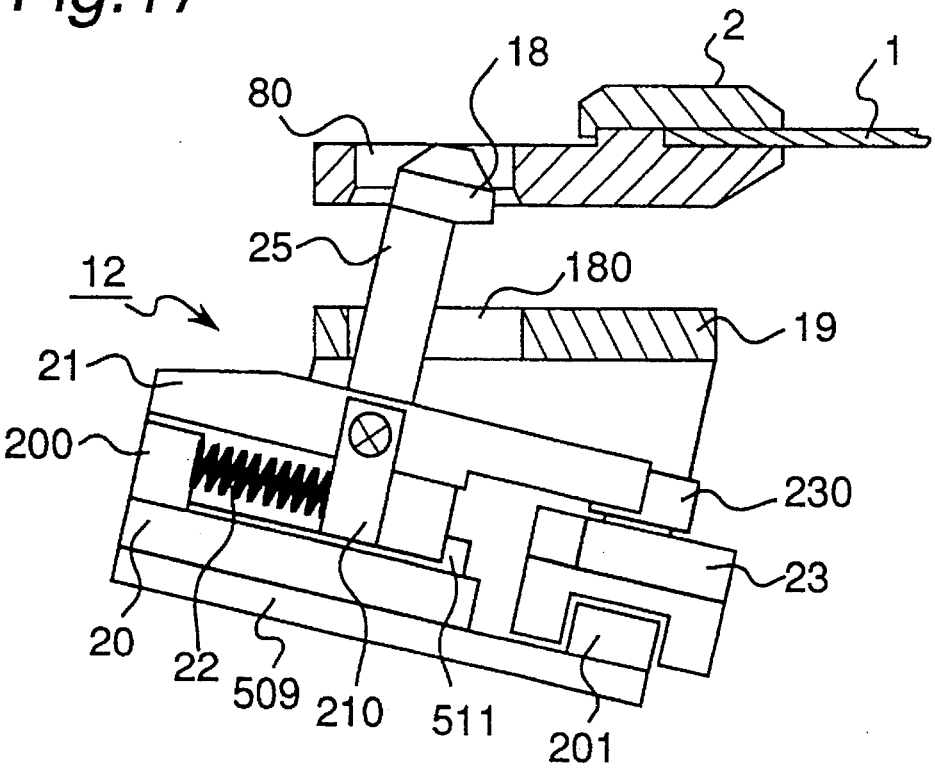
FIG. 17 is a view for describing an elastic plate holder-chucking operation of the first chucking means shown in FIG. 2 and a state in which the elastic plate holder has not been placed on a placing base.
Figure 18:
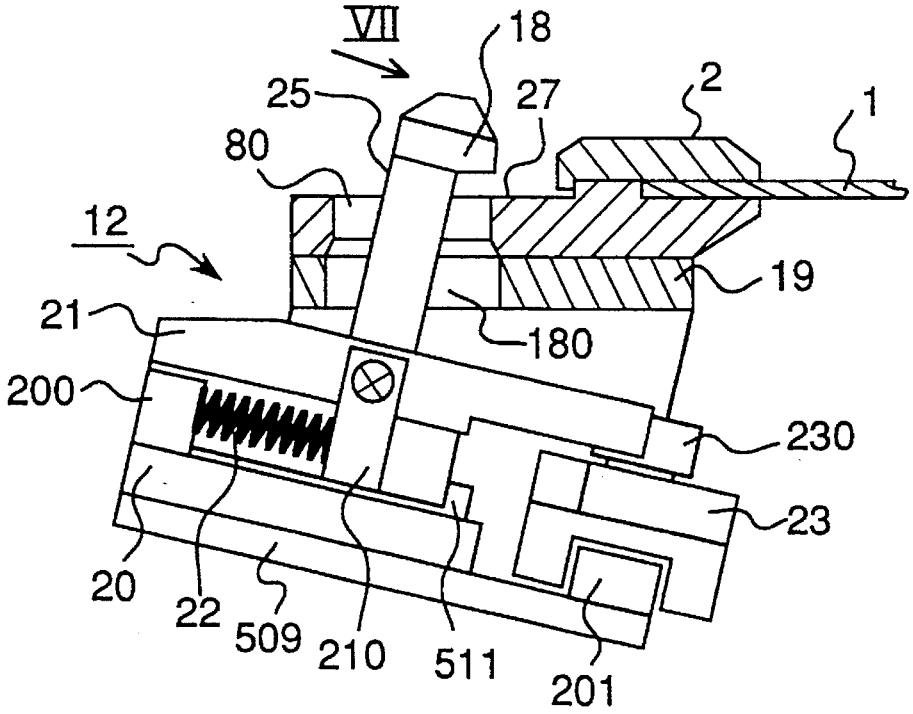
FIG. 18 is a view for describing the elastic plate holder-chucking operation of the first chucking means shown in FIG. 2 and a state in which the elastic plate holder has been placed on the placing base.
Figure 19:
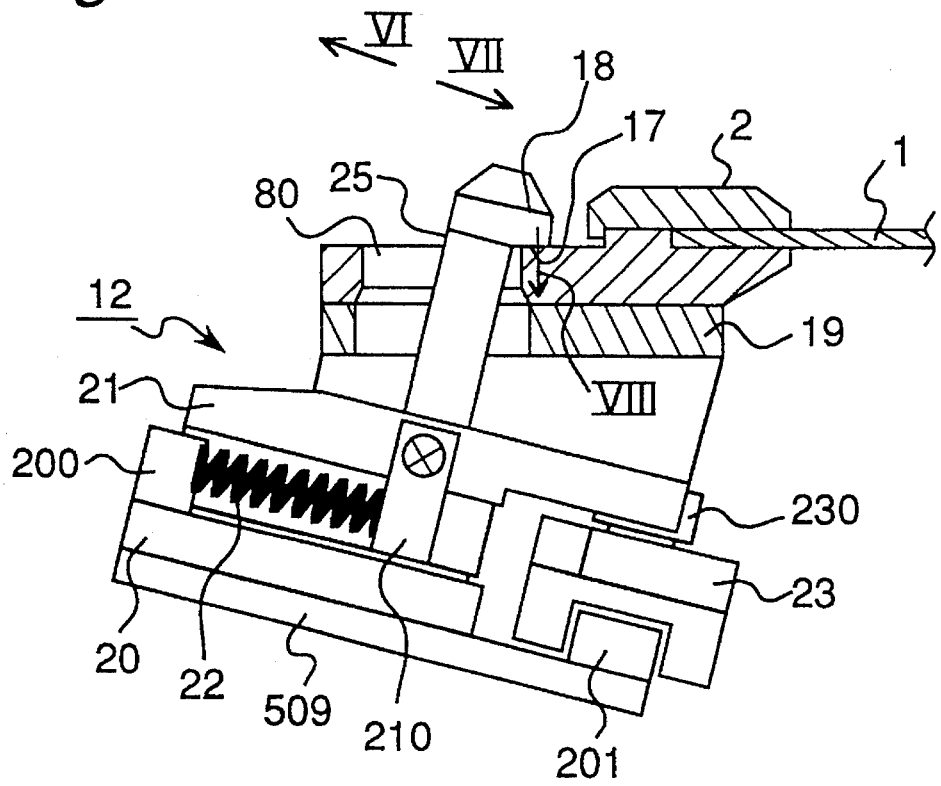
FIG. 19 is a view for describing the elastic plate holder-chucking operation of the first chucking means shown in FIG. 2 and a state in which the elastic plate holder has been placed on the placing base by being chucked by the first chucking means.
Figure 25:
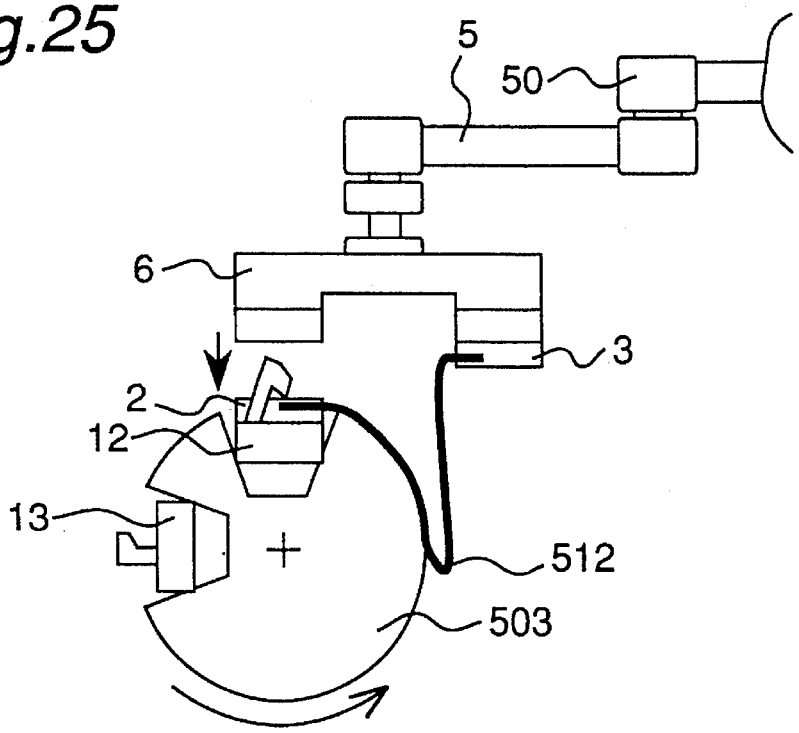
FIG. 25 is a view for describing the operation of installing the thin-film forming elastic plate on the printing roll barrel by using the printing roll and the thin-film forming elastic plate according to the present invention and a state in which the installation of the thin-film forming elastic plate on the printing roll barrel has been started.

As shown in FIGS. 17, 18, and 25, the first elastic plate holder 2 chucked by the hand 6 is moved downward by driving the arm 5. Each of the first printing roll-chucking holes 80 formed on the first elastic plate holder 2 is caught by each of the claws 18 formed on the first chucking member 25 of the first chucking means 12 of the printing roll barrel 503 by preventing the claw 18 from contacting the inner wall 10 of each of the first printing roll-chucking holes 80 , and the first elastic plate holder 2 is placed on the first placing base 19 of the first chucking means 12. With this operation, the positioning pin 14 erected on the first placing base 19 is inserted into the positioning hole 9 formed on the first elastic plate holder 2, as shown in FIG. 15. The arm 5 is driven in various directions via the joint 50 of the articulated robot 4 or the robot base is moved vertically.

Then, as shown in FIG. 19, the cylinder 24 is driven to move the first chucking member 25 in a direction shown by an arrow VII, and the claw 18 of the first chucking member 25 is pressed against the opening edge 27 of the first printing roll-chucking hole 80 formed on the first elastic plate holder 2. As a result, the opening edge 27 of the first printing roll-chucking hole 80 is subjected to the force acting vertically, namely, in the direction shown by the arrow VIII by the claw 18 of the first chucking member 25, and the first elastic plate holder 2 is pressed against the first placing base 19 and fixed thereto.

Then, the air cylinder 555 of the hand 6 is driven to release the first elastic plate holder 2 from the chucking member 29 and remove the claw 18 of the chucking member 29 from the hand-chucking hole 7 so as to move the hand 6 upward.

Figure 26:
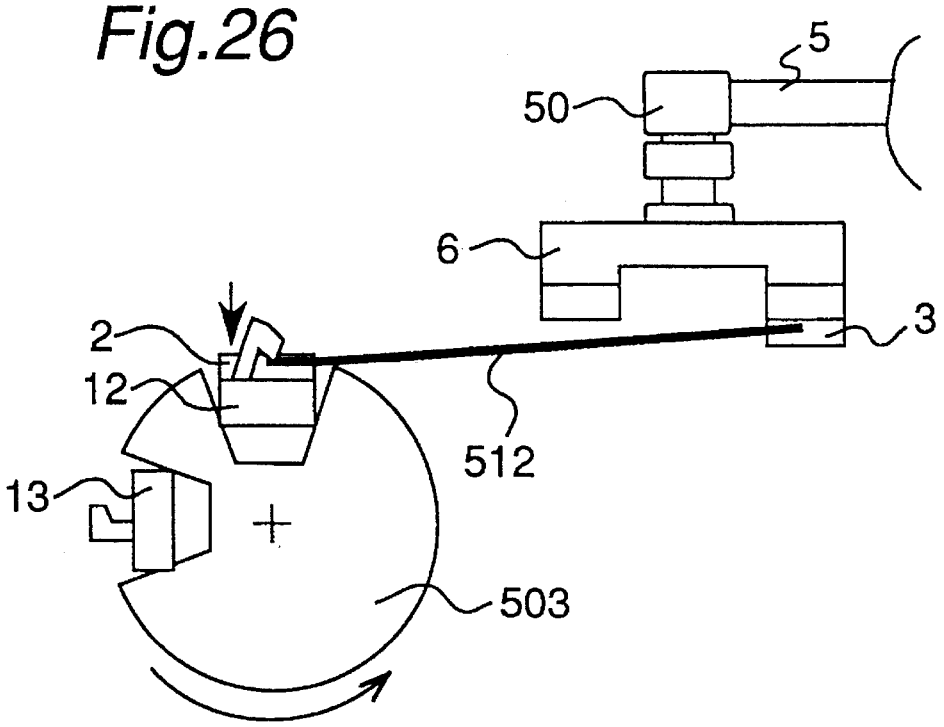
FIG. 26 is a view for describing the operation of installing the thin-film forming elastic plate on the printing roll barrel by using the printing roll and the thin-film forming elastic plate according to the present invention and a state subsequent to the state shown in FIG. 25.

Thereafter, the cylinder 24 is driven to move the first chucking member 25 of the first chucking means 12 in the direction shown by the arrow VI of FIG. 19 so as to unlock the first elastic plate holder 2 from the first chucking member 25. Then, as shown in FIG. 26, by driving the arm 5 of the articulated robot 4, the elastic portion 1 is pulled by the claw 18 of the second chucking member 15 which has penetrated into the second printing roll-chucking hole 81, and the positioning pin 14 is brought into contact with the inner wall 10 of the positioning hole 9, as shown in FIG. 16.

Then, the cylinder 24 is driven to move the first chucking member 25 in the direction shown by the arrow VII of FIG. 19 to press the claw 18 of the first chucking member 25 against the opening edge 27 of the first printing roll-chucking hole 80 of the first elastic plate holder 2. In this manner, the fixing of the first elastic plate holder 2 to the first placing base 19 is completed.

Figure 27:
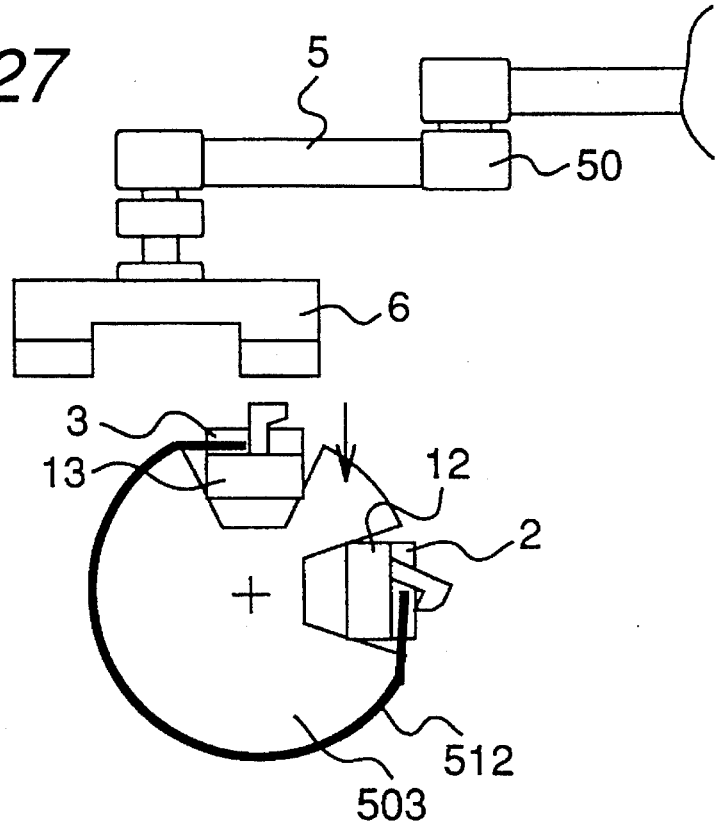
FIG. 27 is a view for describing the operation of installing the thin-film forming elastic plate on the printing roll barrel by using the printing roll and the thin-film forming elastic plate according to the present invention and a state in which the thin-film forming elastic plate has been installed on the printing roll barrel.

Thereafter, the arm 5 of the articulated robot 4 is driven to move the hand 6 toward the printing roll barrel 503 gradually while the printing roll barrel 503 is being rotated in a direction in which the thin-film forming elastic plate 512 is wound thereon. As shown in FIG. 27, in this manner, the second elastic plate holder 3 of the thin-film forming elastic plate 512 is moved to a position, of the printing roll barrel 503, at which the second chucking means 13 has been mounted.

Then, as shown in FIG. 27, the arm 5 is driven to move the second elastic plate holder 3 chucked by the hand 6 downward, and the claw 18 is inserted into the second printing roll-chucking hole 81 by preventing the claw 18 of the second chucking member 15 of the second chucking means 13 from contacting the inner wall 10 of the printing roll-chucking hole 81 formed on the second elastic plate holder 3. In this manner, the second elastic plate holder 3 is placed on the second placing base 190.

Thereafter, the cylinder 24 is driven to move the second chucking member 15 in the direction shown by the arrow VII of FIG. 21 to press the tapered surface 17 of the second chucking member 15 against the tapered surface 11 of the printing roll-chucking hole 81 formed on the second elastic plate holder 3. In this manner, the second elastic plate holder 3 is pressed against the second placing base 190 and fixed thereto.

Finally, the second elastic plate holder 3 is unlocked from the chucking member 29 of the hand 6, and the claw 553 of the chucking member 29 is pulled out from the hand-chucking hole 7 to move the hand 6 upward.

In the operation described above, the operation to be performed by the articulated robot 4 and the hand 6 may be done manually by an operator.

In the construction of the above-described embodiment, the first slider 21 and the second chucking member 15 of the second chucking means 13 move in the directions shown by the arrows VI and VII. However, if the elastic portion 1 of the thin-film forming elastic plate 512 generates a sufficient tensile force, the first slider 21 and the second chucking member 15 may be so constructed that they are not moved.

The printing roll and the thin-film forming elastic plate according to the present invention display the following advantage because of the above-described construction and operation:

(1) The use of the printing roll and the thin-film forming elastic plate according to the present invention allows the thin-film forming elastic plate to be fixed to the printing roll barrel and removed therefrom automatically, thus saving time and labor. Hence, the thin-film forming elastic plate can be fixed to the printing roll barrel and removed therefrom very efficiently.

(2) In the use of the printing roll and the thin-film forming elastic plate according to the present invention, the tapered surface of the claw of the chucking means is pressed against the tapered surface of the printing roll-chucking hole of the thin-film forming elastic plate. The operation of pressing the elastic plate holder of the thin-film forming elastic plate against the printing roll barrel and the operation of pulling the thin-film forming elastic plate can be obtained by the operation of pressing the chucking means against the printing roll-chucking hole of the thin-film forming elastic plate. Accordingly, it is unnecessary to consider the order of turning the screws or to turn the screws manually and thus, the thin-film forming elastic plate can be fixed to the printing roll barrel and removed therefrom very easily and efficiently.

(3) The use of the printing roll and the thin-film forming elastic plate according to the present invention eliminates manual operations in fixing the thin-film forming elastic plate to the printing roll barrel and removing the former from the latter. Therefore, a work place is prevented from being dusty and the thin-film forming elastic plate can be prevented from being soiled with dust or oil which has attached to hands. Thus, the thickness of ink transferred to the elastic portion of the thin-film forming elastic plate is uniform and in addition, the ink can be prevented from being polluted.

(4) The use of the printing roll and the thin-film forming elastic plate according to the present invention allows the first and second chucking means provided on the printing roll barrel to pull the elastic portion and press the elastic portion against the printing roll barrel automatically. Accordingly, there is no possibility that operators are injured.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they otherwise depart therefrom.

What is claimed is:

1. A printing roll comprising:

a printing roll barrel;

a thin-film forming elastic plate having an elastic portion to which printing ink is applied; a first elastic plate holder, holding the elastic portion at a leading end thereof that is to travel firstly around with the printing roll, and having a first printing roll-chucking hole penetrating therethrough in a thickness direction of the elastic portion; a second elastic plate holder, holding the elastic portion at a trailing end thereof that is to travel lastly around with the printing roll, and having a second printing roll-chucking hole extending therethrough in the thickness direction of the elastic portion, and which thin-film forming elastic plate is to be wound around said printing roll barrel in the order of the first elastic plate holder, the elastic portion, and the second elastic plate holder along a circumferential direction of the printing roll barrel;

a first chucking means for detachably securing said first elastic plate holder to the printing roll barrel when the thin-film forming elastic plate is wound on the printing roll barrel, said first chucking means comprising a first placing base provided on a part of the circumferential surface of the printing roll barrel and having a front surface, a rear surface, and a through-hole extending from the rear surface to the front surface; a first chucking member extending through said through-hole in the first placing base and insertable into the first printing roll-chucking hole of the first elastic plate holder; and a first driving means, provided at a rear side of the first placing base, for driving the first chucking member, when extending into the first printing roll-chucking hole, into engagement with the first elastic plate holder to chuck the first elastic plate holder to the front surface of the first placing base; and a second chucking means for detachably securing said second elastic plate holder to the printing roll barrel when the thin-film forming elastic plate is wound on the printing roll barrel, said second chucking means comprising a second placing base provided on another part of the circumferential surface of the printing roll barrel and having a front surface, a rear surface, and a through-hole extending from the rear surface to the front surface; a second chucking member extending through said through-hole in the second placing base and insertable into the second printing roll-chucking hole of the second elastic plate holder; and a second driving means, provided at a rear side of the second placing base, for driving the second chucking member, when extending into the second printing roll-chucking hole, into engagement with the second elastic plate holder to chuck the second elastic plate holder to the front surface of the second placing base.

2. The printing roll as claimed in claim 1, wherein the second printing roll-chucking hole of the second elastic plate holder has a portion thereof tapered toward the second placing base; and the second chucking member has a tapered portion corresponding to the tapered portion of the roll-chucking hole.

3. The printing roll as claimed in claim 1, wherein the first driving means comprises:

a first slider, on which the first chucking member is erected, slidable in a direction inclined to a tangent to the printing roll barrel so as to drive the first chucking member into engagement with the first elastic plate holder and disengage the first chucking member therefrom;

a first guide member guiding the first slider in said inclined direction;

a second slider reciprocatable in an axial direction of the printing roll barrel and operatively connected to said first slider so as to reciprocate the first slider in said inclined direction in correspondence with the reciprocating motion of said second slider;

a second guide member guiding said second slider in said axial direction; and a motor means for reciprocating the second slider.

4. The printing roll as claimed in claim 1, wherein the second driving means comprises:

a first slider, on which the second chucking member is erected, slidable in a direction of a tangent to the printing roll barrel so as to drive the second chucking member into engagement with the second elastic plate holder and disengage the second chucking member therefrom;

a first guide member guiding the first slider in said direction of a tangent;

a second slider reciprocatable in an axial direction of the printing roll barrel and operatively connected to the first slider so as to reciprocate the first slider in the tangential direction in correspondence with the reciprocating motion of the second slider;

a second guide member guiding the second slider in said axial direction; and a motor means for reciprocating the second slider.

5. The printing roll as claimed in claim 1, wherein a pair of the first printing roll-chucking holes is formed in the first elastic plate holder; a pair of the second printing roll-chucking holes is formed in the second elastic plate holder; and a pair of the first chucking means and a pair of the second chucking means are provided on the printing roll barrel in correspondence with the first printing roll-chucking holes and the second printing roll-chucking holes.

6. The printing roll as claimed in claim 2, wherein a pair of the first printing roll-chucking holes is formed in the first elastic plate holder; a pair of the second printing roll-chucking holes is formed in the second elastic plate holder; and a pair of the first chucking means and a pair of the second chucking means are provided on the printing roll barrel in correspondence with the first printing roll-chucking holes and the second printing roll-chucking holes.

7. The printing roll as claimed in claim 3, wherein a pair of the first printing roll-chucking holes is formed in the first elastic plate holder; a pair of the second printing roll-chucking holes is formed in the second elastic plate holder; and a pair of the first chucking means and a pair of the second chucking means are provided on the printing roll barrel in correspondence with the first printing roll-chucking holes and the second printing roll-chucking holes.

8. The printing roll as claimed in claim 4, wherein a pair of the first printing roll-chucking holes is formed in the first elastic plate holder; a pair of the second printing roll-chucking holes is formed in the second elastic plate holder; and a pair of the first chucking means and a pair of the second chucking means are provided on the printing roll barrel in correspondence with the first printing roll-chucking holes and the second printing roll-chucking holes.

9. The printing roll as claimed in claim 1, wherein said first chucking means includes a positioning pin, for positioning the first elastic plate holder on the first placing base, erected on the first placing base; and the first elastic plate holder defines therein a positioning hole for receiving the positioning pin.

10. The printing roll as claimed in claim 2, wherein said first chucking means includes a positioning pin, for positioning the first elastic plate holder on the first placing base, erected on the first placing base; and the first elastic plate holder defines therein a positioning hole for receiving the positioning pin.

11. The printing roll as claimed in claim 3, wherein said first chucking means includes a positioning pin, for positioning the first elastic plate holder on the first placing base, erected on the first placing base; and the first elastic plate holder defines therein a positioning hole for receiving the positioning pin.

12. The printing roll as claimed in claim 4, wherein said first chucking means includes a positioning pin, for positioning the first elastic plate holder on the first placing base, erected on the first placing base; and the first elastic plate holder defines therein a positioning hole for receiving the positioning pin.

13. The printing roll as claimed in claim 5, wherein said first chucking means includes a positioning pin, for positioning the first elastic plate holder on the first placing base, erected on the first placing base; and the first elastic plate holder defines therein a positioning hole for receiving the positioning pin.

14. The printing roll as claimed in claim 6, wherein said first chucking means includes a positioning pin, for positioning the first elastic plate holder on the first placing base, erected on the first placing base; and the first elastic plate holder defines therein a positioning hole for receiving the positioning pin.

15. The printing roll as claimed in claim 7, wherein said first chucking means includes a positioning pin, for positioning the first elastic plate holder on the first placing base, erected on the first placing base; and the first elastic plate holder defines therein a positioning hole for receiving the positioning pin.

16. The printing roll as claimed in claim 8, wherein said first chucking means includes a positioning pin, for positioning the first elastic plate holder on the first placing base, erected on the first placing base; and the first elastic plate holder defines therein a positioning hole for receiving the positioning pin.

17. A thin-film forming elastic plate, to be installed on a printing roll barrel, comprising:

an elastic portion to which printing ink is to be applied;

a first elastic plate holder holding the elastic portion at a leading end thereof that is to travel firstly around with a printing roll, said first elastic plate holder having a hand-chucking hole, which is to be held and released by a hand installed on an arm of a robot, and which hand-chucking hole penetrates through the first elastic plate holder in a direction of thickness of the elastic portion, and said first elastic plate holder having a first printing roll-chucking hole, which is to be held and released by a first chucking means of a printing roll barrel, and which printing roll-chucking hole penetrates through the first elastic plate holder in the direction of thickness of the elastic portion; and a second elastic plate holder holding the elastic portion at a trailing end thereof that is to travel lastly around with the printing roll, said second elastic plate holder having a hand-chucking hole, which is to be held and released by the hand installed on the arm of the robot, and which hand-chucking hole penetrates through the second elastic plate holder in the direction of thickness of the elastic portion, and said second elastic plate holder having a second printing roll-chucking hole, which is to be held and released by a second chucking means of the printing roll barrel, and which second printing roll-chucking hole penetrates through the second elastic plate holder in the direction of thickness of the elastic portion.

18. The thin-film forming elastic plate as claimed in claim 17, wherein the hand-chucking hole of each of the first and second elastic plate holders has a tapered portion for use in guiding the hand of the robot thereinto, and the second printing roll-chucking hole of the second elastic plate holder has a tapered portion for allowing the second chucking means to engage the second elastic plate holder.

19. The thin-film forming elastic plate as claimed in claim 17, wherein the first elastic plate holder has a positioning hole to be used when the first chucking means of the printing roll barrel holds the first elastic plate holder.

20. The thin-film forming elastic plate as claimed in claim 17, wherein the hand-chucking hole of each of the first and second elastic plate holders has a tapered portion for use in guiding the hand of the robot thereinto, and the second printing roll-chucking hole of the second elastic plate holder has a tapered portion for allowing the second chucking means to engage the second elastic plate holder; and the first elastic plate holder has a positioning hole to be used when the first chucking means of the printing roll barrel holds the first elastic plate holder.

* * * * *